US006685394B1

(12) United States Patent
Allen et al.

(10) Patent No.: US 6,685,394 B1
(45) Date of Patent: Feb. 3, 2004

(54) PARTIAL SHROUD WITH PERFORATING FOR VIV SUPPRESSION, AND METHOD OF USING

(75) Inventors: Donald W. Allen, Richmond, TX (US); Dean L. Henning, Needville, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/645,715

(22) Filed: Aug. 24, 2000

(51) Int. Cl.[7] ..... E02D 5/60; B63B 34/44; F15D 1/10

(52) U.S. Cl. ..... 405/211; 405/224.2; 114/264; 114/243

(58) Field of Search ..... 405/195.1, 211, 405/211.1, 212, 224.2, 224.4; 114/243, 264, 265, 266, 267, 67 R; 166/355, 367; 175/5–7

(56) References Cited

U.S. PATENT DOCUMENTS 3,248,886 A * 5/1966 Blenkarn ..... 405/211
4,102,144 A * 7/1978 Anders ..... 405/211
4,578,000 A * 3/1986 Lindqvist et al. ..... 405/211
4,606,673 A * 8/1986 Daniell ..... 405/224.2
4,632,600 A * 12/1986 Ito ..... 405/211
5,549,417 A * 8/1996 Ju et al. ..... 405/211
5,875,728 A * 3/1999 Ayers et al. ..... 114/264
6,223,672 B1 * 5/2001 Allen et al. ..... 114/243
6,244,785 B1 * 6/2001 Richter et al. ..... 405/195.1
6,309,141 B1 * 10/2001 Cox et al. ..... 405/224
6,401,646 B1 * 6/2002 Masters et al. ..... 114/243

FOREIGN PATENT DOCUMENTS

WO WO 9527101 A1 * 10/1995 ..... E02B/17/00

* cited by examiner

*Primary Examiner*—Jong-Suk (James) Lee
(74) *Attorney, Agent, or Firm*—Gilbreth & Associates, P.C.; J. Mark Gilbreth; Mary A. Gilbreth

(57) ABSTRACT

Apparatus and methods for environments subject to vortex induced vibration. The system includes a shroud having a number of perforations, with the shroud encircling the flowing-fluid element less than 100%. The system further includes a separation member for attaching the shroud to the flowing-fluid element.

33 Claims, 24 Drawing Sheets

| Vnom. | RE | Vcorr. | Vr |
|---|---|---|---|
| 2.00 | 7.10E+04 | 2.05 | 3.64 |
| 2.20 | 7.81E+04 | 2.26 | 4.01 |
| 2.40 | 8.52E+05 | 2.46 | 4.37 |
| 2.60 | 9.23E+04 | 2.67 | 4.71 |
| 2.80 | 9.94E+04 | 2.87 | 5.10 |
| 3.00 | 1.06E+05 | 3.08 | 5.47 |
| 3.20 | 1.14E+05 | 3.28 | 5.83 |
| 3.40 | 1.21E+05 | 3.49 | 6.20 |
| 3.60 | 1.28E+05 | 3.69 | 6.56 |
| 3.80 | 1.35E+05 | 3.90 | 6.92 |
| 4.00 | 1.42E+05 | 4.10 | 7.29 |
| 4.20 | 1.49E+05 | 4.31 | 7.65 |
| 4.40 | 1.56E+05 | 4.51 | 8.02 |
| 4.60 | 1.63E+05 | 4.72 | 8.38 |
| 4.80 | 1.70E+05 | 4.92 | 8.75 |
| 5.00 | 1.77E+05 | 5.13 | 9.11 |
| 5.20 | 1.85E+05 | 5.33 | 9.48 |
| 5.40 | 1.92E+05 | 5.54 | 9.84 |
| 5.60 | 1.99E+05 | 5.74 | 10.20 |
| 5.80 | 2.06E+05 | 5.95 | 10.57 |
| 6.00 | 2.13E+05 | 6.15 | 10.93 |

*FIG. 43*

PARTIAL SHROUD WITH PERFORATING FOR VIV SUPPRESSION, AND METHOD OF USING

BACKGROUND OF THE INVENTION

1. Field of the Invention

The present invention relates to methods and apparatus for suppressing vortex-induced vibrations ("VIV") In another aspect, the present invention relates to apparatus and methods for suppressing VIV in flowing-fluid environments by the use of shrouds, and to flowing-fluid elements incorporating such shrouds. In even another aspect, the present invention relates to apparatus and methods for suppressing VIV in aquatic environments by the use of shrouds, and to aquatic elements incorporating such shrouds. In still another aspect, the present invention relates to apparatus and methods for suppressing VIV utilizing a partial shroud with perforations easily attached to and/or encircling a flowing-fluid element.

2. Description of the Related Art

Whenever a bluff body, such as a cylinder, experiences a current in a fluid, it is possible for the body to experience vortex-induced vibrations (VIV) These vibrations are caused by oscillating hydrodynamic forces on the surface which can cause substantial vibrations of the structure, especially if the forcing frequency is at or near a structural natural frequency. The vibrations are largest in the transverse (to flow) direction; however, in-line vibrations can also cause stresses which are sometimes larger than those in the transverse direction.

Drilling for and/or producing hydrocarbons or the like from subterranean deposits which exist under a body of water exposes underwater drilling and production equipment to water currents and the possibility of VIV. Equipment exposed to VIV includes structures ranging from the smaller tubes of a riser system, anchoring tendons, or lateral pipelines to the larger underwater cylinders of the hull of a minispar or spar floating production system (hereinafter "spar").

Risers are discussed here as a non-exclusive example of an aquatic element subject to VIV. A riser system is used for establishing fluid communication between the surface and the bottom of a water body. The principal purpose of the riser is to provide a fluid flow path between a drilling vessel and a well bore and to guide a drill string to the well bore.

A typical riser system normally consists of one or more fluid-conducting conduits which extend from the surface to a structure (e.g., wellhead) on the bottom of a water body. For example, in the drilling of a submerged well, a drilling riser usually consists of a main conduit through which the drill string is lowered and through which the drilling mud is circulated from the lower end of the drill string back to the surface. In addition to the main conduit, it is conventional to provide auxiliary conduits, e.g., choke and kill lines, etc., which extend parallel to and are carried by the main conduit.

Also, the newly developed spar production facilities are used in aquatic environments of great depths. Strong water currents often occur at these greater depths in ocean environments. The hulls of spar production facilities, therefore, can be exposed to excessive vortex-induced vibrations.

This drilling for and/or producing of hydrocarbons from aquatic, and especially offshore, fields has created many unique engineering challenges. For example, in order to limit the angular deflections of the upper and lower ends of the riser pipe or anchor tendons and to provide required resistance to lateral forces, it is common practice to use apparatus for adding axial tension to the riser pipe string. Further complexities are added when the drilling structure is a floating vessel, as the tensioning apparatus must accommodate considerable heave due to wave action. Still further, the lateral forces due to current drag require some means for resisting them whether the drilling structure is a floating vessel or a platform fixed to the subsurface level.

The magnitude of the stresses on the riser pipe, tendons or spars is generally a function of and increases with the velocity of the water current passing these structures and the length of the structure.

It is noted that even moderate velocity water currents acting on linear structures can cause stresses. Such moderate or higher currents are readily encountered when drilling for offshore oil and gas at greater depths in the ocean or in an ocean inlet or near a river mouth.

Drilling in ever deeper water depths requires longer riser pipe strings which because of their increased length and subsequent greater surface area are subject to greater drag forces which must be resisted by more tension. This is believed to occur as the resistance to lateral forces due to the bending stresses in the riser decreases as the depth of the body of water increases. Accordingly, the adverse effects of drag forces against a riser or other structure caused by strong and shifting currents in these deeper waters increase and set up stresses in the structure which can lead to severe fatigue and/or failure of the structure if left unchecked.

There are generally two kinds of water current induced stresses.

The first kind of stress is caused by vortex-induced alternating forces that vibrate the underwater structure ("vortex-induced vibrations") in a direction perpendicular to the direction of the current. When water flows past the structure, vortices are alternately shed from each side of the structure. This produces a fluctuating force on the structure transverse to the current. If the frequency of this harmonic load is near the resonant frequency of the structure, large vibrations transverse to the current can occur. These vibrations can, depending on the stiffness and the strength of the structure and any welds, lead to unacceptably short fatigue lives. In fact, stresses caused by high current conditions have been known to cause structures such as risers to break apart and fall to the ocean floor.

The second type of stress is caused by drag forces which push the structure in the direction of the current due to the structure's resistance to fluid flow. The drag forces are amplified by vortex induced vibrations of the structure. For instance, a riser pipe that is vibrating due to vortex shedding will disrupt the flow of water around it more than a stationary riser. This results in more energy transfer from the current to the riser, and hence more drag.

Many methods have been developed to reduce vibrations of sub sea structures.

Some of these methods to reduce vibrations caused by vortex shedding from subsea structures operate by stabilization of the wake. These methods include streamlined fairings, wake splitters and flags.

Streamlined or teardrop shaped, fairings that swivel around a structure have been developed that almost eliminate the sheading or vortexes. The major drawbacks to teardrop shaped fairings is the cost of the fairing and the time required to install such fairings. Additionally, the critically required rotation of the fairing around the structure is challenged by long-term operation in the undersea environment. Over time in the harsh marine environment, fairing rotation may either be hindered or stopped altogether. A non-rotating fairing subjected to a cross-current may result in vortex shedding that induces greater vibration than the bare structure would incur.

Wake splitters are flat plates that extend from the back of a cylindrical structure parallel to the current flow direction. These wake splitters have been found to be effective in creating a symmetric vortex pattern so that each vortex "sees" an image created by the rigid splitter plate giving symmetry with respect to the axis in the direction of flow. Splitter plates also stabilize the separation points, decrease the wake width and reduce drag. Unfortunately, splitter plates suffer from most of the same detrimental effects as teardrop shaped fairings for off-axis currents. They must therefore either be rotatable or be used only where the directions of a significant current does not vary. Flags are similar to wake splitters, but are flexible. They are not generally as effective as wake splitters, but have the advantage that they can wrap around a structure and remain somewhat effective with varying current directions without being rotatable. From time to time flags will become wrapped around the structure and become ineffective, requiring human interaction to unwrap the flag. In shallow waters, it is not too difficult or too costly to unwrap a flag. However, flags are not commonly used in sub sea applications because of this chance of wrapping, and also because of the difficulty and expense of attaching the flag to the structure along the length of the structure.

Other of these methods to reduce vibrations caused by vortex shedding from sub sea structures operate by modifying the boundary layer of the flow around the structure to prevent the correlation of vortex shedding along the length of the structure. Examples of such methods include the inclusion of helical strakes around a structure, or axial rod shrouds and perforated shrouds.

Where possible, it is often preferred to utilize shrouds over fairings, wake splitters and flags. However, a major drawback of prior art shrouds is that they are costly and time consuming to install.

Thus, there is a need in the art for apparatus and methods for suppressing VIV.

There is another need in the art for apparatus and methods for suppressing VIV which do not suffer from the disadvantages of the prior art.

There is even another need in the art for apparatus and methods for installation of VIV suppression devices which address at least some of the deficiencies of the prior art.

These and other needs of the present invention will become apparent to those of skill in the art upon review of this specification, including its drawings and claims.

SUMMARY OF THE INVENTION

It is one object of the present invention to provide for apparatus and methods for suppressing VIV.

It is another object of the present invention to provide for suppressing VIV which do not suffer from the disadvantages of the prior art.

It is even another object of the present invention to provide for apparatus and methods for installation of VIV suppression devices which address at least some of the deficiencies of the prior art.

These and other objects of the present invention will become apparent to those of skill in the art upon review of this application, including its drawings and claims.

According to one embodiment of the present invention, there is provided a system for use with a flowing-fluid element subject to vortex induced vibration. The system includes a shroud defining a plurality of perforations, wherein the shroud is suitable for placement around the flowing-fluid element, and wherein the shroud is suitable for providing a percent of encirclement of the flowing-fluid element of less than 100%. The system also includes at least one separation member in contact with the shroud, wherein the separation member is suitable for positioning between the fluid flowing element and the shroud to maintain the shroud and element in relative position to each other.

According to another embodiment of the present invention, there is provided a system suitable for use in vortex induced vibration prone environments. The system includes a flowing-fluid element. The system also includes a shroud positioned around the flowing-fluid element, where the shroud defines a plurality of perforations, and wherein the shroud encircles the flowing-fluid element at a percent of encirclement of less than 100%.

According to even another embodiment of the present invention, there is provided a method for modifying a flowing-fluid element subject to vortex induced vibration. The method includes positioning a shroud around the flowing-fluid element, wherein the shroud defines a plurality of perforations, wherein the shroud is suitable for placement around the flowing-fluid element, and wherein the shroud is suitable for providing a percent of encirclement of the flowing-fluid element of less than 100%.

In the above embodiments, the flowing-fluid element may be attached to, connected to, or otherwise a part of any type of offshore structure, non-limiting examples of which include, bottom supported and vertically moored structures, such as for example, fixed platform, compliant tower, tension leg platform, and mini-tension leg platform, and also include floating production and subsea systems, such as for example, SPAR platform, floating production systems, floating production storage and offloading, and subsea system.

BRIEF DESCRIPTION OF THE DRAWINGS

FIG. 30 shows tank test results for drag coefficients and Reynolds numbers for ¼ coverage partial shrouds, ½" holes, 64% porosity, without rods and 67.5 degree current angle.

FIG. 41 shows a plan view of the modified current tank facility with dimensions provided.

FIG. 42 shows a section view of the modified current tank facility with dimensions provided.

FIG. 43 is a table showing the relationships between nominal velocity (Vnom.), Reynolds number (RE), corrected test velocity (Vcorr.), and reduced velocity (Vr).

DETAILED DESCRIPTION OF THE INVENTION

The VIV suppression systems of the present invention generally include a shroud member defining a number of perforations, and include a separation member for maintaining the shroud member and the element to be protected from VIV in a spatial relationship to each other. The separation member may be attached to one or both of the shroud member and the element to be protected.

The VIV systems of the present invention are capable of working in any flowing fluid environment in which the structural integrity of the system can be maintained. The term, "flowing-fluid" is defined here to include but not be limited to any fluid, gas, or any combination of fluids, gases, or mixture of one or more fluids with one or more gases, specific non-limiting examples of which include fresh water, salt water, air, liquid hydrocarbons, a solution, or any combination of one or more of the foregoing. Preferably, the flowing-fluid is considered "aquatic" meaning the flowing-fluid comprises water, and more preferably comprises sea water or freshwater, and even more preferably comprises a mixture of fresh water and seawater.

Figure 1:
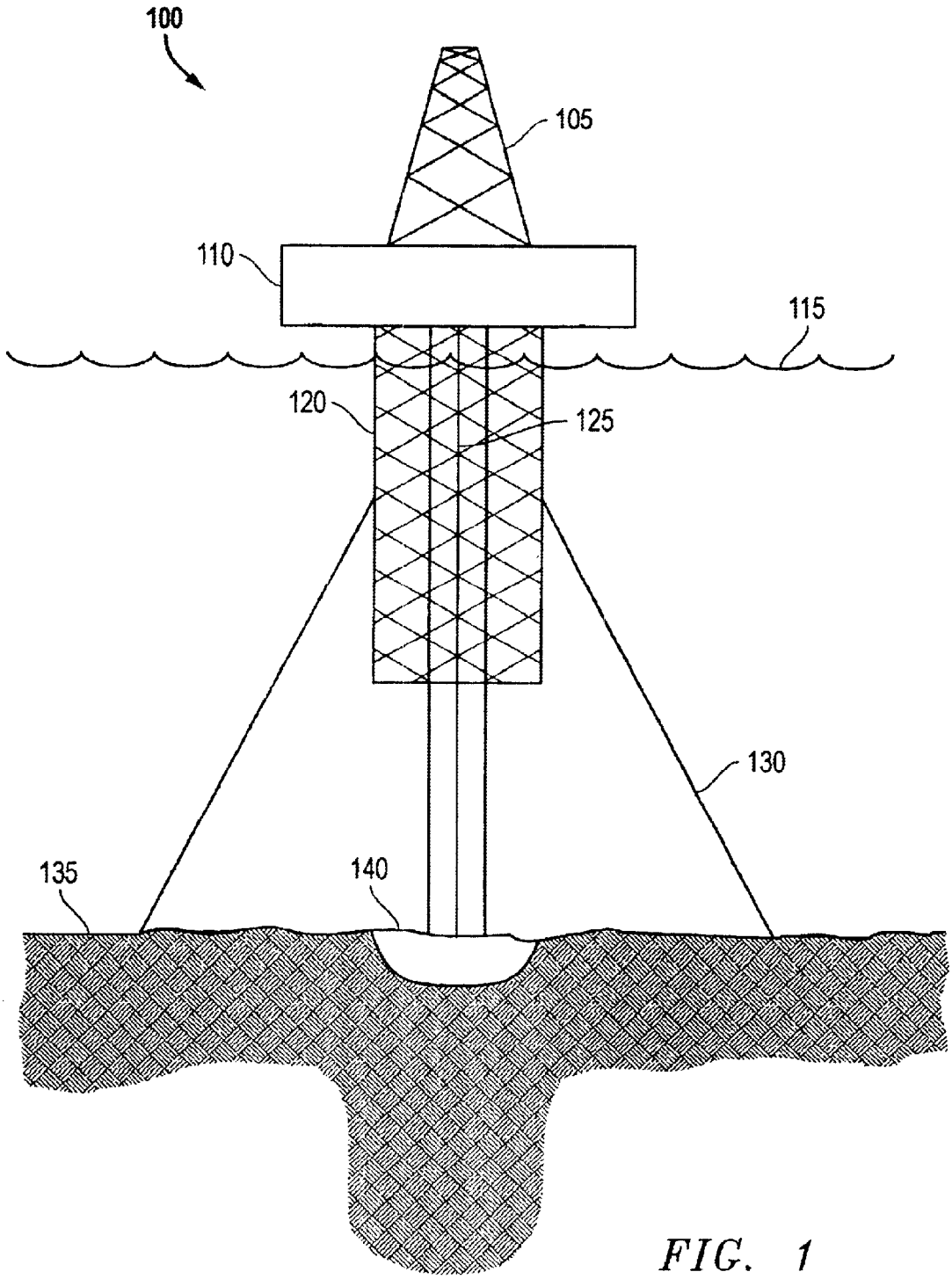
FIG. 1 is an illustration of a typical environment in which the present invention may be deployed, showing a SPAR drilling and production facility 100, showing surface platform 110 and derrick 105, SPAR hull 120, risers 125, support tendons 130, wells 140, the surface of ocean 115 and ocean floor 135.

Referring first to FIG. 1, there is illustrated a typical flowing-fluid environment showing a number of possible structures, such as SPAR hull 120, risers 125, and tendons 130 are all individually subject to VIV caused by water currents, on which the present invention may be deployed.

FIG. 1 shows offshore platform 100, in particular a SPAR floating drilling and production system, which includes surface facilities 105 and 110, hull of the SPAR 120, risers 125, support tendons 130, and wells 140.

The perforated shrouds of the present invention, can sufficiently suppress VIV when appropriately attached to, for example, hull 120, risers 125 and/or tendons 130.

Figure 2:
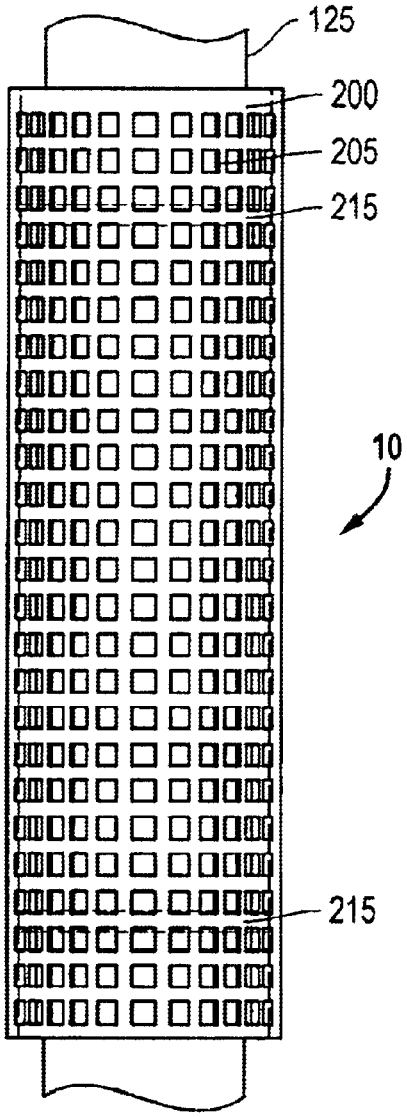
FIG. 2 shows a half-around shroud application 200 of the present invention regularly perforated by holes 205 and attached to a ring 215 that attaches to and separates the shroud 200 from the riser 125.
Figure 3:
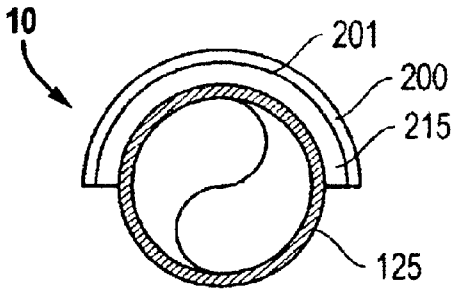
FIG. 3 shows a cross-section of the structures shown in FIG. 2.

Referring now to FIGS. 2 and 3, there is shown a non-limiting example of one embodiment of VIV system 10 of the present invention, comprising a half-around shroud 200 of the present invention, which shroud is regularly perforated by a multiplicity of holes 205 and attached to rings 215 that position shroud 200 away from riser 125.

It should be understood that the shroud of the present invention may encircle a structure with different percentages of encirclement, depending upon the operating environment, the structure being encircled, and cost. As used herein, "percentage of encirclement" refers to the extent to which the shroud circumferentially surrounds the structure. For example, shroud 200, shown as having a 180° cross-sectional circular segment, will have a percentage of encirclement of riser 125 of 50% (i.e., 180°/360°×100%). As another example, a shroud having a 90° cross-sectional circular segment shape will have a percentage of encirclement of 25% (i.e., 90°/360°×100%).

The lower end of the range of the extent of encirclement is generally about 1%, preferably about 12%, more preferably about 25%, even more preferably about 45%.

The upper end of the range of the extent of encirclement is selected independently of the lower end to be greater than the lower end, and is generally about 99%, preferably about 80%, more preferably about 70%, and even more about 55%.

Non-limiting, non-exhaustive examples of suitable ranges of the extent of encirclement possible from the above listed lower and upper ends include ranging from about 1% to about 99%, from about 12% to about 80%, from about 25% to about 70%, and from about 45% to about 55%. Of course, it is to be understood that other ranges may be formed by selection of other combinations of upper and lower ends.

In the practice of the present invention, the porosity of the shroud may vary depending upon the operating environment, the structure to which the shroud is attached, and cost. As used in the present invention, "porosity" generally means the percentage of the surface area of a shroud penetrated by perforations.

The suitable ranges of porosity may vary, with the lower end of the range generally about 1%, preferably about 10%, more preferably about 15%, and even more preferably about 25%.

The upper end of the porosity range is selected independently of the lower end to be greater than the lower end, with the upper end of the range of porosities generally about 99%, preferably about 80%, more preferably 70%, and even more preferably about 60%.

Non-limiting, non-exhaustive examples of suitable ranges of porosity possible from the above listed lower and upper ends include ranging from about 1% to about 99%, from about 10% to about 80%, from about 15% to about 70%, and from about 25% to about 60%. Of course, it is to be understood that other ranges may be formed by selection of other combinations of upper and lower ends.

In the practice of the present invention, any suitable size of perforation may be utilized provided that the desired structural integrity of the shroud, and suitable VIV protection are achieved. In general, the size of the perforations in the shroud may vary depending upon the material of the shroud, the size of the shroud, the operating environment, the structure being encircled and cost, as well as other engineering factors.

In the practice of the present invention, the shape of the perforation may be any shape suitable for the purpose of VIV suppression. Non-limiting examples of suitable shapes include any regular or irregular n-sided geometric shape, or any linear or curvilinear geometric shape. Specific non-limiting examples include square, rectangle, triangle, circle, oval, ellipsoid, or the like, and any combinations thereof.

While shroud 200 is show as having a regular pattern of square perforations 205, it should be understood that in the practice of the present invention, any suitable regular or irregular pattern, ordering, or random placement of perforations, or any combination of the above, may be utilized, provided that the desired structural integrity of the shroud, and suitable VIV protection are achieved.

Thus, the pattern of perforations of the shroud is selected so as to be suitable for the operational environment, the structure to which the shroud is applied, and cost. Non-limiting examples of patterns of perforations include random, regular, irregular, or ordered.

In the embodiment of VIV suppression system as shown in FIGS. 2 and 3, the entire vertical extent of inner surface 201 of shroud 200 is shown to be positioned a uniform distance away from riser 125. However, it should be understood that various portions of inner surface 201 may be positioned at various distances away from riser 125. For example, the vertical extent of inner surface 201 may be of a sinusoidal (or any other desired) shape (or alternatively, the riser surface may be of a variable shape) with the distance between surface 201 and riser 125 varying.

The spacing distance between adjacent rings of the two or more rings 215 are selected based on operating conditions, engineering factors, and other factors as necessary. This spacing may be uniform between all rings, or may vary between adjacent rings.

Figure 4:
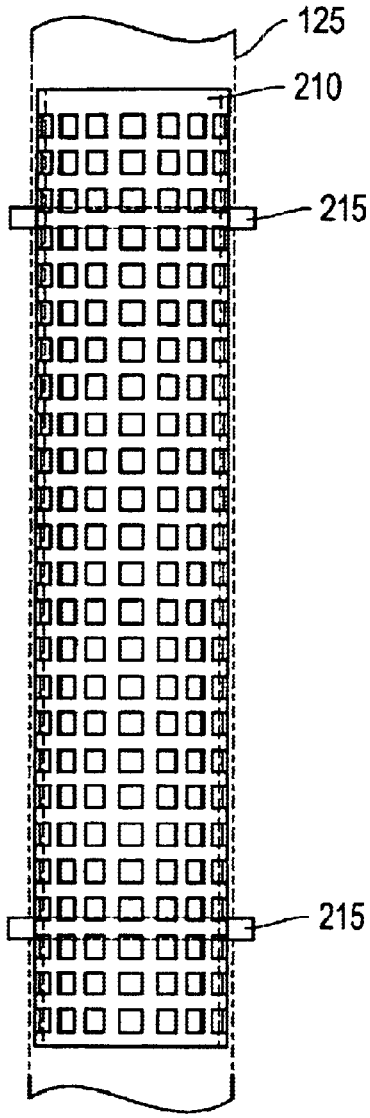
FIG. 4 shows a quarter-around application 210 of the present invention showing selected structures shown in FIGS. 2 and 3.
Figure 5:
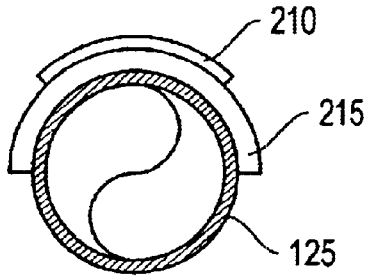
FIG. 5 shows a cross-section of selected structures shown in FIG. 4.

Referring additionally to FIGS. 4 and 5, there is shown shroud 210, another embodiment of the VIV suppression system of the present invention. Shroud 210, is a quarter-around application with a 25% extent of encirclement of riser 125. Ring 215 serves the same functions as it does in the half-around application in FIGS. 2 and 3.

Figure 6:
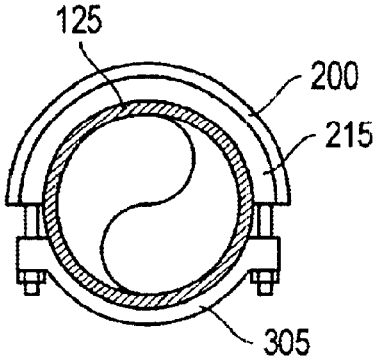
FIG. 6 shows a retainer cap ring and method 305 in cross-section for the half-around application of the present invention and selected structures shown in FIG. 2.
Figure 7:
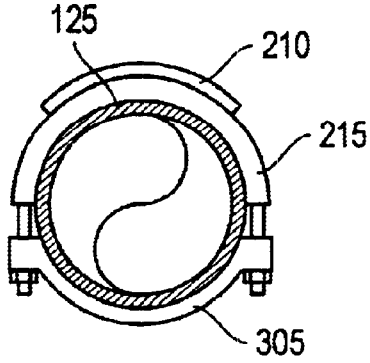
FIG. 7 shows a retainer cap ring and method 305 in cross-section for the quarter-around application of the present invention and selected structures shown in FIG. 4.

Referring also to FIGS. 6 and 7, there is shown the use of retainer cap 305 to attach ring 215 in the half-around 200 and quarter-around 210 embodiments.

Figure 8:
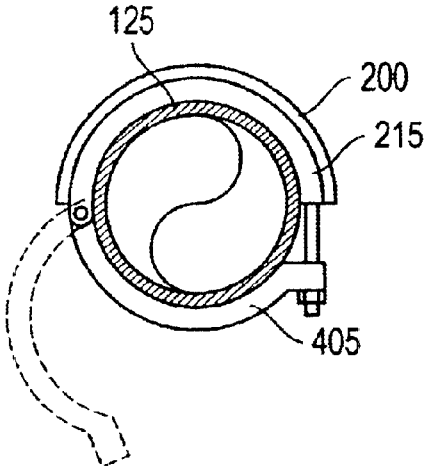
FIG. 8 shows a hinged cap ring and method 405 in cross-section for the half-around application of the present invention and selected structures shown in FIG. 2.
Figure 9:
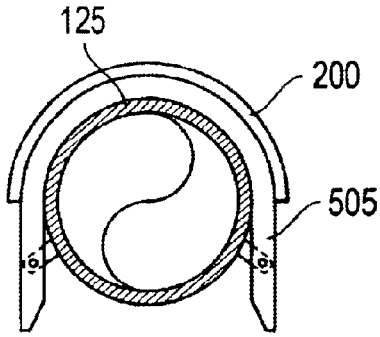
FIG. 9 shows a "spring-loaded dogs" ring and method 505 in cross-section and selected structures shown in FIG. 2.

Referring also to FIGS. 8 and 9, there are shown alternative attachment apparatus for shrouds 200 and 210, such as hinged cap 405 in FIG. 8, and spring-loaded dogs 505 in FIG. 9.

Of course, it should be understood that the above attachment apparatus and methods are merely illustrative, and any other suitable attachment apparatus may be utilized.

Figure 10:
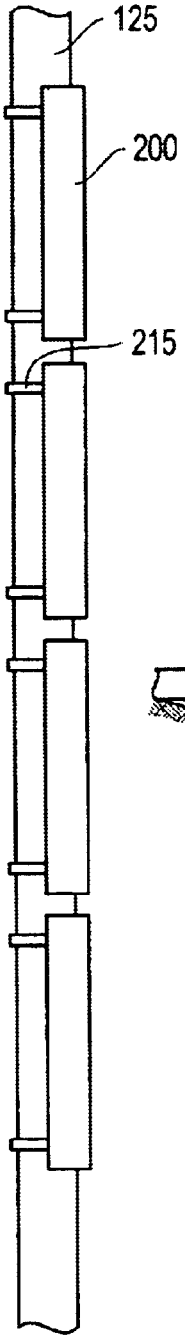
FIG. 10 shows the half-around application of the shroud of the present invention to a riser with selected parts shown in FIG. 2.

Referring now to FIG. 10, there are shown a multiplicity of half-around shrouds 200 on riser 125. Shown is an example of one non-limiting spacing method for shroud 200 along a portion of the length of riser 125. It should be understood that more than one shroud may be utilized in the practice of the present invention. It should also be understood that the spacings between any adjacent pair of shrouds may be the same or different than the spacings between any another adjacent pair of shrouds.

Figure 11:
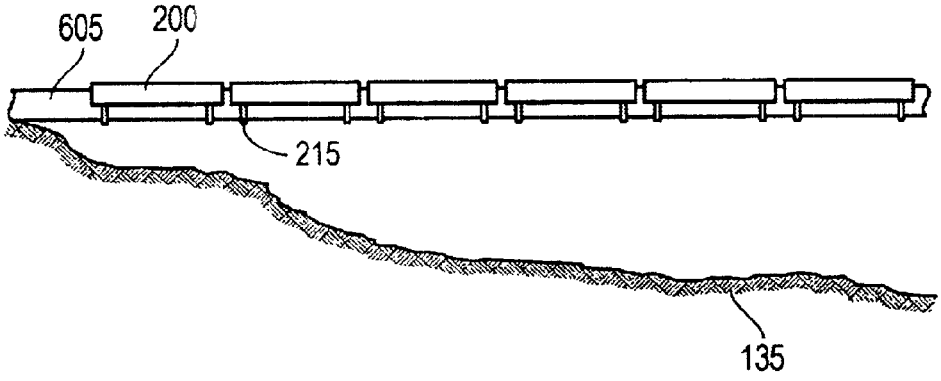
FIG. 11 shows the half-around application of the shroud of the present invention to a lateral pipe span 605 with selected structures shown in FIGS. 1 and 2.

Referring to FIG. 11, there is shown an embodiment of half-around shroud 200 on a lateral underwater pipeline span 605, such as across a flowing river. Shown is one example of a non-limiting spacing arrangement of the attachment of shroud 200 along a portion of lateral pipe span 605.

Figure 16:
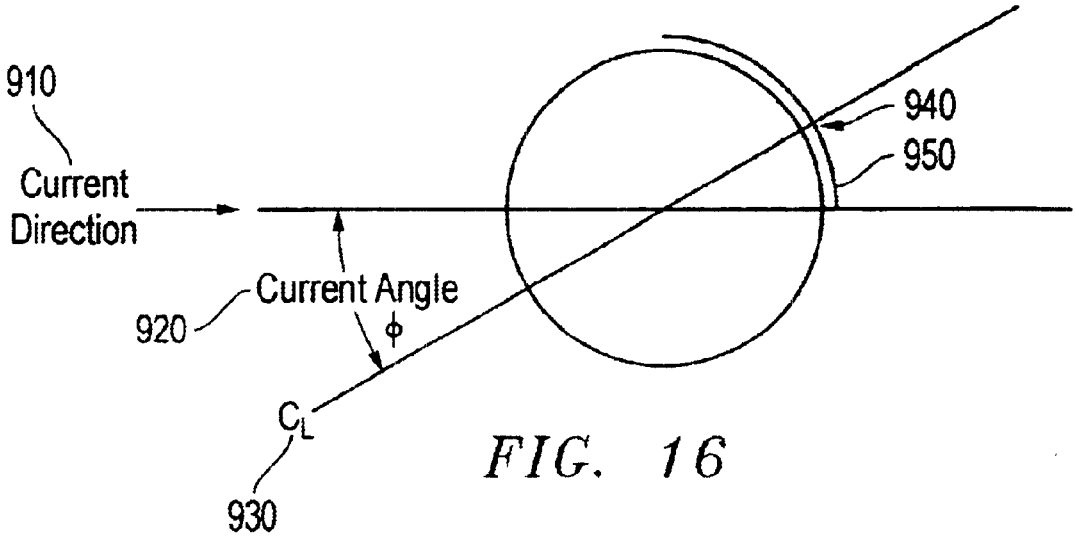
FIG. 16 shows the current angle definition showing current direction 910, current angle 920, line defined by cylinder center and center of shroud 930, center of shroud 940, and perforated shroud (¼ coverage) 950.
Figure 17:
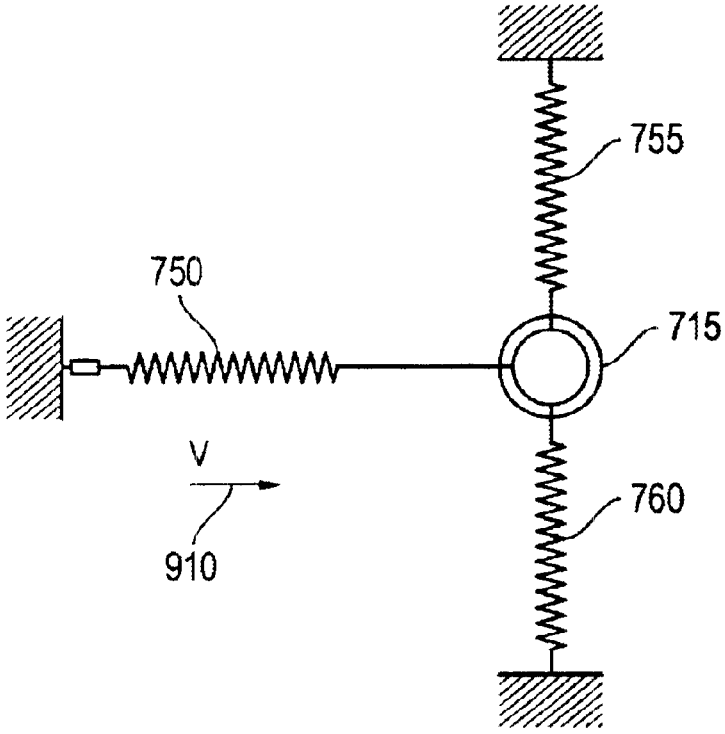
FIG. 17 shows the plan view of the spring attachments to the spring attachment ring 715 for the tests of the present invention as shown in FIG. 12.
Figure 18:
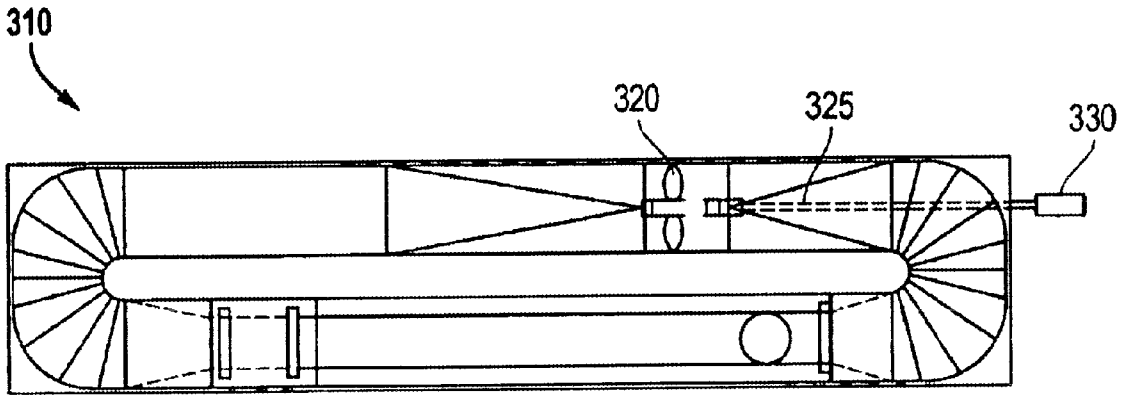
FIG. 18 shows the modified current tank facility 310 with ships propeller 320 that creates the current, drive shaft 325, and hydraulic power unit 330.
Figure 19:
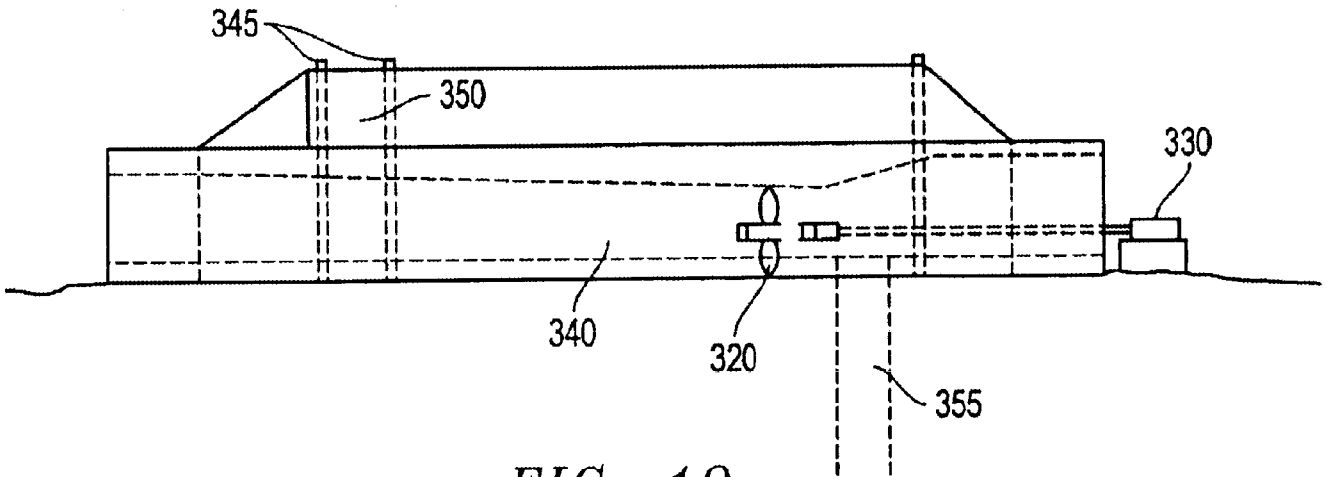
FIG. 19 shows an elevation view of the cental part of the current tank facility. In addition to the structures identified in FIG. 18, shown in FIG. 19 are tank 340, shear screens 345, straighteners 350, and caisson 355.

Referring now to FIG. 16, there is shown the definition of current angle $\phi$, showing current direction 910, current angle 920, line $C_L$ defined by cylinder center and center of shroud 930, center of shroud 940, and perforated shroud (¼ coverage) 950.

In the practice of the present invention, any suitable current angle $\phi$ may be utilized provided that VIV is reduced. Generally, current angle $\phi$ will be in the range of about 0 to about 360 degrees, more preferably in the range of about 20 to about 180 degrees, even more preferably in the range of about 45 to about 135 degrees, and still more preferably in the range of about 62 to about 72 degrees.

The present invention finds utility with most any type of offshore structure, non-limiting examples of which include, bottom supported and vertically moored structures, such as for example, fixed platform, compliant tower, tension leg platform, and mini-tension leg platform, and also include floating production and subsea systems, such as for example, SPAR platform, floating production systems, floating production storage and offloading, and subsea system.

EXAMPLES

The following examples are provided to illustrate the present invention. The examples are not intended to and do not limit the scope of the claims of the present invention, and should not be so interpreted.

The following examples describe a test in a current tank of perforated shrouds 205 and 210 partially covering the circumference of a spring-mounted rigid cylinder 705. Current tank tests have been performed with a spring-mounted cylinder used to approximate the hull of a spar. The cylinder has been tested with and without perforated shrouds partially covering the cylinder's circumference used to suppress vortex-induced vibrations. Both ¼ and ½ coverage shrouds (i.e, similar to shrouds 210 and 205 described above) were tested at various angles relative to the current. Tests have also been conducted with and without underlying axial rods 710 used to simulate production risers 125. Test results show that for the ¼ coverage shrouds 210, the effectiveness is improved by the presence of the underlying axial rods 710. The results also show that the ½ coverage shroud is generally more effective than the ¼ coverage shroud 210, and that the optimal current angle for both amounts of coverage is about 67.5°.

Test Description

Current Tank

All of the experiments were performed in a current tank facility shown in FIGS. 18, 19, 41, and 42. A ship's propeller 320 driven through a gear and chain drive arrangement by a hydraulic power unit 330 circulates the water through the tank. Screens 345 sandwich two honeycomb sections (straighteners) 350 which are used to minimize turbulence and fluid rotational effects (it is believed that the tank has small-scale turbulence on the order of 2 to 2.5 percent). Slats in the screens are used to produce sheared velocity profiles when desired; however, for these tests, uniform flow was used.

A 50-foot deep, 3-foot inside diameter steel caisson 355 is located in the test section to allow for tubes as long as about 60 feet. The excitation region of the test section is 12 feet deep by 3½ feet wide and is produced by a fixed steel insert with baffles that change the cross-sectional dimensions of the flow area from 7 feet deep by 6 feet wide to the test section dimensions of 12 feet deep by 3½ feet wide and then back to 7 feet deep by 6 feet wide beyond the test section.

Model Test Setup

Figure 12:
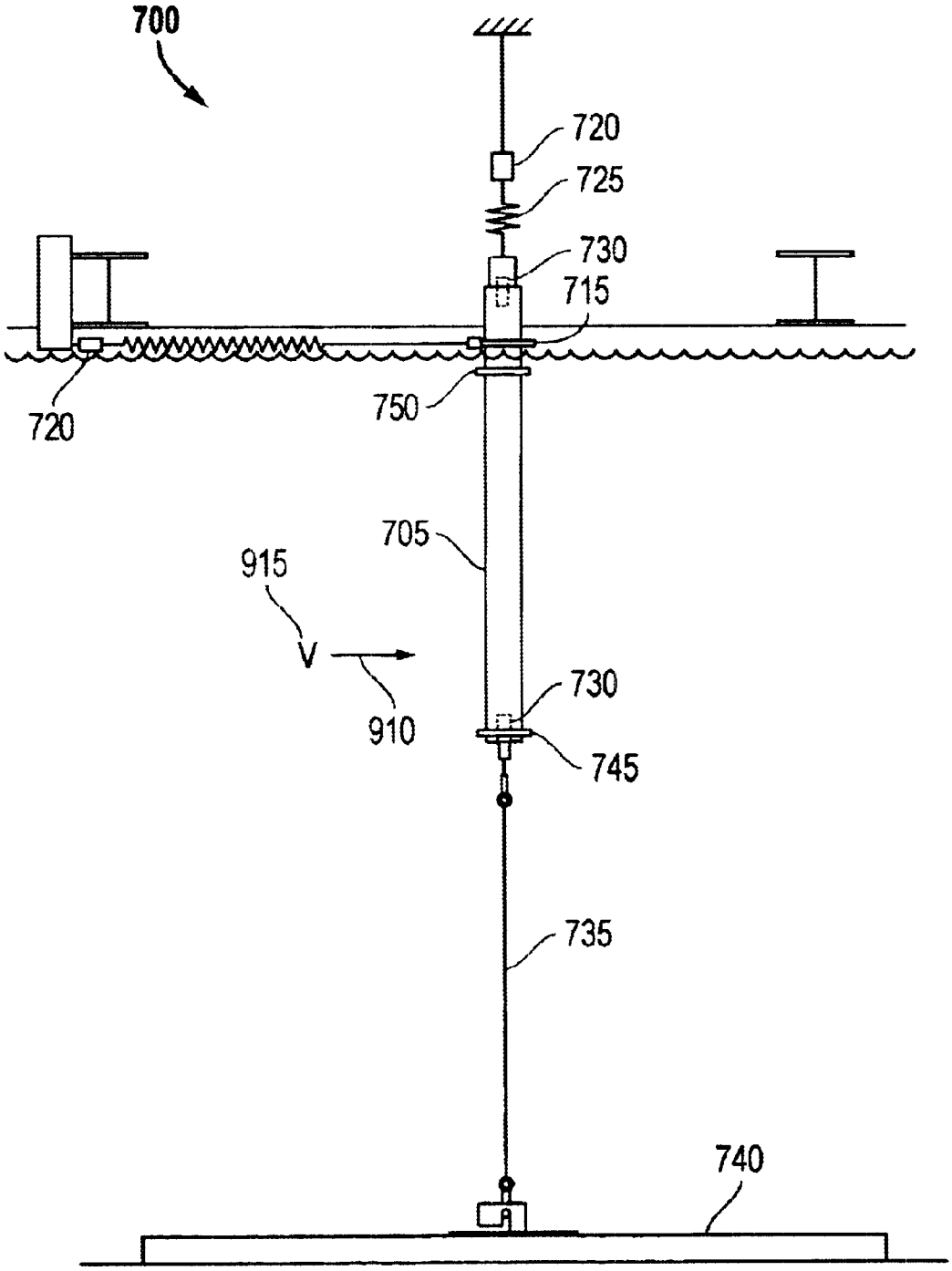
FIG. 12 shows the spring-mounted rigid cylinder VIV test setup 700 used to test the present invention. Shown are cylinder 705, shroud separation ring(s) 710, spring attachment ring 715, two load cells 720, spring 725, two accelerometers 730, wire rope with tape ribbon 735, and beam 740.
Figure 13:
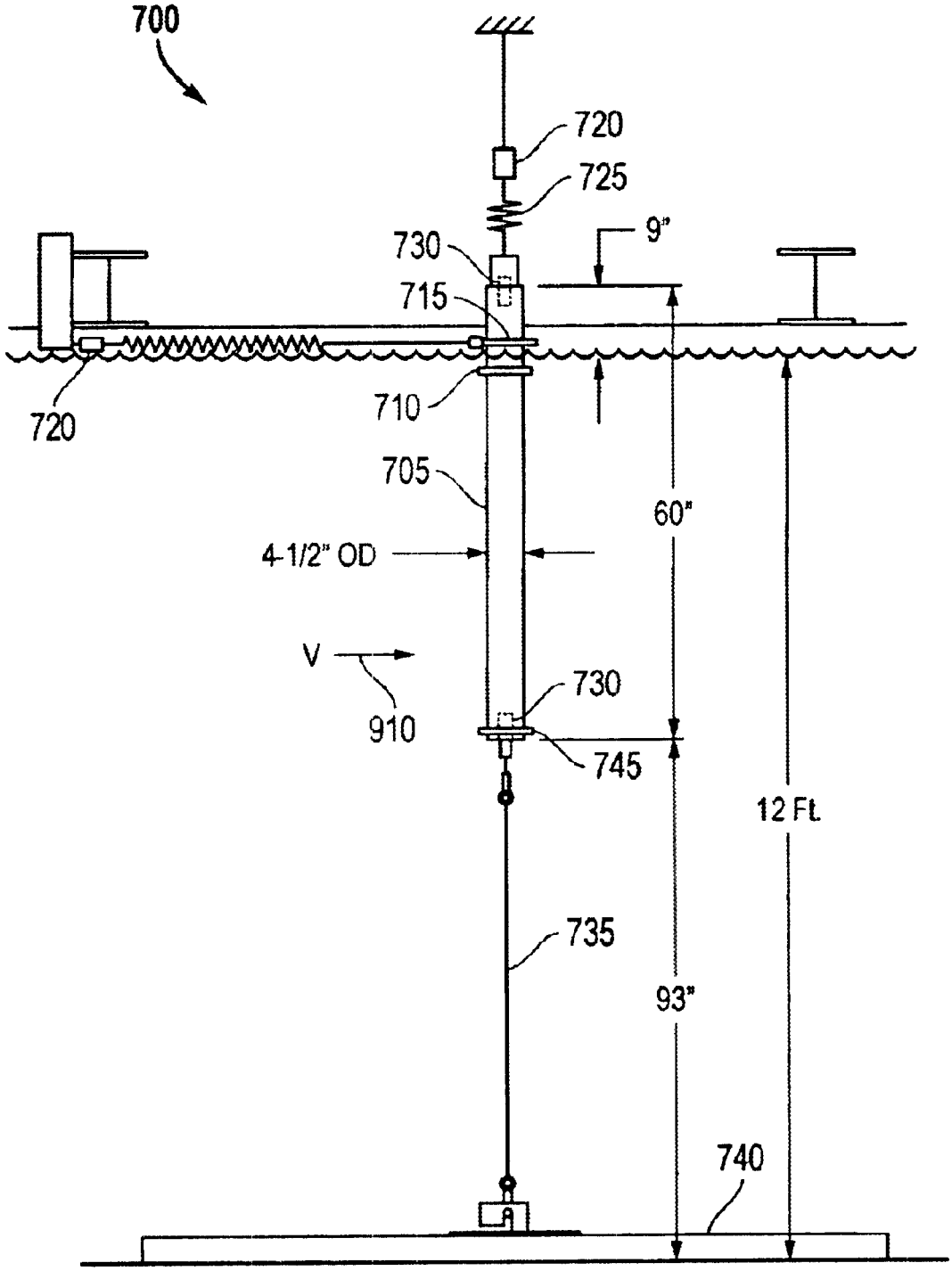
FIG. 13 shows a dimensioned drawing of the test setup shown in FIG. 12.
Figure 14:
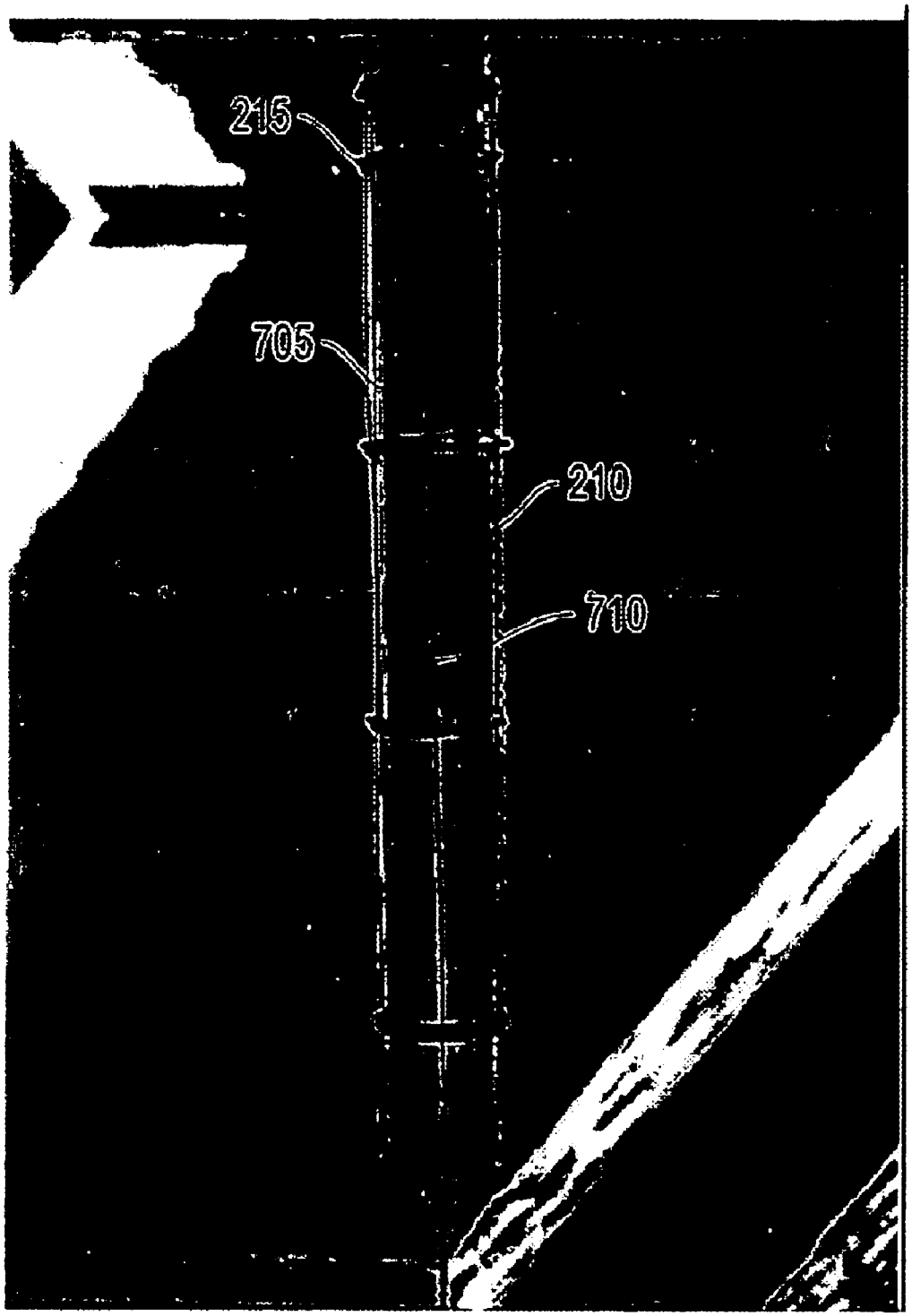
FIG. 14 show a photograph of the test setup shown in FIG. 12. Shown are test cylinder 705, ring 215, shroud 210 and axial rod 710.
Figure 15:
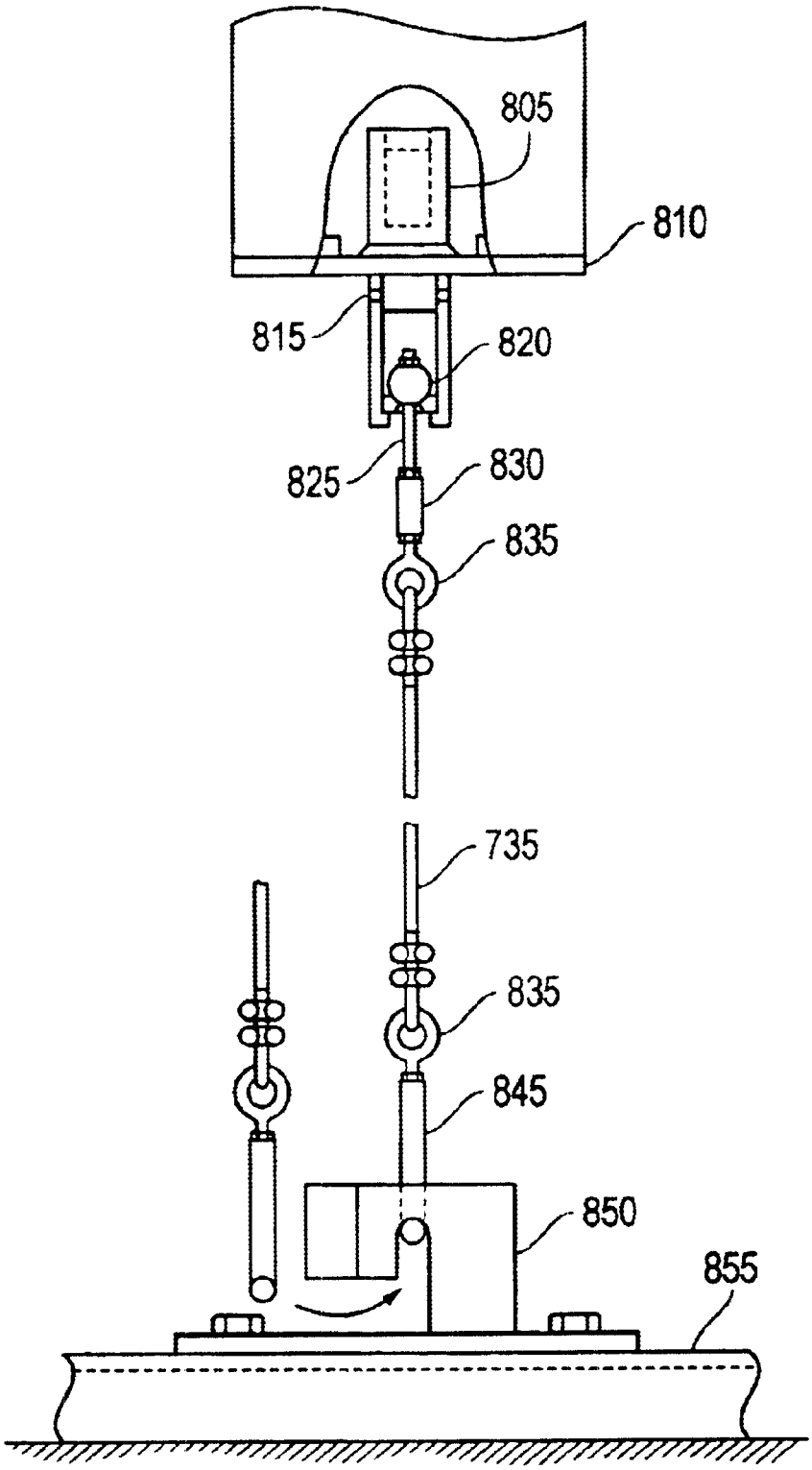
FIG. 15 shows an illustration of the minispar tether anchor setup used in tests of the present invention, showing wire rope 735, accelerometer housing 805, bottom plate bolted to minispar, set screws 815, spherical bearing 820, all-thread 825, threaded connector 830, eye bolts 835, T anchor 845, anchor bracket 850, and channel on bottom of current tank 855.

Referring to FIGS. 12–20, 41 and 42, the test cylinder 705 consisted of a polished aluminum tube with a 4.5-inch outside diameter (OD) and a 4.26 inch inside diameter (ID). The cylinder 705 was air-filled (and sealed) and mounted with a tendon 735 and a top spring assembly 725 as shown in FIGS. 12 and 13. The test cylinder 705 was 4.875 feet long and was installed with approximately 4 feet of its length submerged (the water line sometimes varied by as much as one inch during the tests). The end caps and pieces for mounting the accelerometers produced a total height of about 5 feet as shown in FIG. 13. The weight of the test cylinder 705 in air was 10.68 lb, which includes the end caps. The bottom of the test cylinder had ball joint 820 and eyebolt 835 (connected to the ball joint) for attachment to the wire rope (tendon) 735. Accelerometers 805 were mounted at the top and bottom of the test cylinder 705 inside specially machined inserts in the end caps, so that they were 4 feet 10 inches apart.

The tendon 735 consisted of a 0.125-inch diameter wire rope 735. Vinyl tape was wrapped around the tendon in order to suppress VIV of the tendon. The bottom of the tendon had a thimble and an eye 835 which was hooked to a T-bar 845 that was inserted into a latching mechanism. The latching mechanism was bolted to a beam 740 at the bottom of the current tank (see FIG. 15).

The cylinder 705 had three rings attached to it. The top ring 715, located about 2 inches above the water line (10 inches from the top of the cylinder), was used for attaching in-line and transverse springs. It was made of aluminum and had a weight in air of 0.55 lb. The second ring 750, located right at the waterline, was used for attaching the axial rods when they were used. The rods were extended to the lower ring 745, which was located so that the bottom of the ring was flush with the bottom of the test cylinder 705. Both shroud separation rings were made of stainless steel and weighed 1.8 lb in air. A gap between the rods 710 and the cylinder 705 was maintained with seven O-rings spaced equally 6 inches apart between the second and lower attachment rings. The O-rings had a 0.25-inch cross-sectional diameter which maintained the 0.25-inch gap between the axial rods and the test cylinder. Once the rods were installed, a second set of three O-rings were installed to fit over the rods at every other inner O-ring location, so that the outer O-rings were 1 foot apart. The outer O-rings were installed in order to minimize VIV of the rods. For tests without axial rod shrouds, foam rings ⅜-inch to ½-inch thick were used to space the perforated shrouds from the cylinder.

A top (vertical) spring 725 having a stiffness of 100 lb/in. was located just above the test cylinder, and a load cell 720 was mounted between the top spring and the test frame. The cylinder 705 was installed with a top spring in order to provide additional top tension to the model and minimize static deflection of the model (excessive static deflections would have caused misalignment of the transverse springs 755 and 760; severe static pitch misalignment would have produced unrealistic tests). The in-line spring 750 had a stiffness of 25 lb/in. and was made up of two 50 lb/in. springs and a 0.125-inch steel cable in series. A load cell 720 used to measure drag forces was located between the spring 750 and an upstream support system which consisted of a plate bolted to a beam across the top of the current tank. The two transverse (to flow) springs 755 and 760 had stiffnesses of 4 lb/in. each and were mounted between the test cylinder spring attachment ring 715 and brackets welded to the current tank side walls.

The axial rods 710, when used, were inserted through 0.25-inch holes in the shroud attachment rings 745 and 750. In each ring, screws were used to hold the rods in place at the rings, which produced a 0.25-inch gap between the rods and the cylinder. Twelve 3⁄32-inch diameter rods were used for the tests with underlying axial rods. The perforated shrouds were punched from stainless steel and rolled into the desired configuration. They were held at a desired current angle by attaching them to the upper 750 (the ring at the top of the water column) and lower 745 support rings. FIG. 16 illustrates the definition of current angle used for these tests.

Test Parameters and Procedure

Several pluck tests were performed on the bare cylinder 705 setup in order to determine the natural frequencies in sway and roll (normal-to-the-flow). These were both found to be 1.50 Hz.

The bare cylinder 705 was first tested. It had the spring attachment 715 and shroud attachment 745 and 750 rings installed before the tests. This was done because it was felt that the presence of the rings would negligibly affect the test results and because it was desired to have the bare cylinder natural frequencies as close to the shrouded cylinder natural frequencies as possible. The first test velocity was 2.0 ft/sec, and the velocities 915 were then increased in 0.2 ft/sec increments until 6.0 ft/sec was tested. The velocities were then decreased in 0.2 ft/sec increments, until 2.0 ft/sec was again reached. The velocity reversing tests were performed in order to ascertain potential hysteresis effects.

The test parameters and procedure used in the bare cylinder 705 tests were also used in all of the test series performed with the shrouded cylinders, except that none of the reversing tests were performed, since previous tests had not revealed any hysteresis effects. For each shroud configuration tested that had axial rods 710 underneath, the rods 710 were oriented so that a rod 710 was located at the upstream stagnation point, and so that the angles between the rods 710 were equal.

The nominal tension imposed on the cylinder 705 before turning on the current was 150 lb. The tension was allowed to increase when the current was turned on and was not adjusted thereafter.

Instrumentation and Data Acquisition

Columbia HEVP-14 biaxial accelerometers 805 were used to measure the accelerations and were mounted at the top and bottom of the test cylinder. Prior to the tests, the accelerometers 805 were calibrated with a shaker assembly and were found to be accurate to within 1.5 percent over the range of 1 to 5 Hz.

Current profiles were measured with a Marsh McBirney Model 523 electromagnetic flowmeter placed at the model location. These profiles were all established before the tests were conducted and were found to be uniform to within about 1 percent. The mean velocity was monitored by a tachometer attached to the propeller drive shaft 325, under the assumption that the propeller drive shaft rpm is a unique function of the mean velocity. This relationship has been well established by numerous velocity measurements during the recent history of the current tank.

The in-line drag force was measured using a Hottinger USB20100 load cell with a range of 200 lb. The load cell 720 was calibrated and checked for linearity prior to testing. Since the load cell 720 did not directly measure the drag load, but instead measured the in-line force at the in-line spring attachment point, a load calibration test was performed by pulling on the test cylinder at a point halfway between the test cylinder bottom and the water line with a known force (measured with another precalibrated load cell). Thus, it was assumed that a force variation along the cylinder length caused a linear change in the drag load cell measurement.

The top tension was measured using a Hottinger USB20100 load cell with a range of 0 to 200 lb. The weight of the top ball joint assembly 820, about 1.2 lb, was not subtracted from the measured tension during data processing. The load cell 720 was calibrated and checked for linearity prior to testing.

The analog accelerometer voltage signals were first amplified using Columbia Model 9002 charge amplifiers. The amplified signals were then digitized by LABTECH NOTEBOOK data acquisition software, controlling a Data Translation DT2801 board, and stored on the hard disk drive of a missing Byte 386 desk top computer. The signals were also stored in analog form by a TEAC XR510 tape recorder. The analog signals were low-pass filtered at 40 Hz (to eliminate tank noise, electrical noise, etc.), using Frequency Devices analog filters, before the data were acquired by LABTECH NOTEBOOK software. Data acquisition paramenters were selected based upon the expected vibration frequencies during the tests and so that there were 2048 data points (2048 is a power of 2 and was selected for ease of use in Fourier transforms in each time series). Note that the vibrations were also monitored during the tests by a dual-channel FFT analyzer.

Data Analysis

The data analysis was performed using a custom data analysis package on an HP730 workstation, which performed the following steps for each test:

1. The raw accelerations were scaled according to the gain settings on the charge amplifiers, rotated if static rotation was measured, and converted to the proper engineering units.

2. The accelerations were next Fast Fourier Transformed to produce frequency spectra of both the in-line and the transverse directions.

3. Acceleration power spectra were computed from the frequency spectra for both the in-line and the transverse directions.

4. The acceleration power spectra were filtered from the high-pass filter setting of 1.0 Hz to a low-pass filter setting of 16 Hz. A 10-point cosine taper was used in the filtering process.

5. The acceleration power spectra were twice integrated (first-order integration with tilt correction) to compute rms displacements for that test.

6. The mean tensions were computed.

7. The mean drag coefficients were computed from the mean drag forces (arithmetic average) that were measured by the in-line load cell and corrected from the load cell calibration.

Surge and sway rms displacements were computed by averaging the top and bottom displacement time series and then computing the rms values in the in-line and transverse directions, respectively. Similarly, the pitch and roll angles were computed by subtracting the bottom displacement time series from the top displacement time series to obtain the relative displacement and then computing the time series of the angle using the relative displacement time series and the known length of the test cylinder (the length used was the distance between the accelerometer centers, which was 4.875 feet). The pitch and roll rms angles were then computed from the in-line end transverse angle time series, respectively.

Blockage Correction

Whenever obstacles are placed in a channel flow, there is a blockage effect due to acceleration of the flow past the obstacles. For most tests that have been conducted in the current tank 310, this effect has been quite small, since the cylinder is usually much less than 5 percent of the test section width. In these tests, however, it was necessary to quantify the blockage effect, since the ratio of the test section width to cylinder width was only 9 ⅓ to 1 (42 inches to 4.5 inches). An attempt was made to quantify the blockage effect as a correction to the free-stream velocity, since this most accurately characterizes the physical effect of blockage and can be used readily to correct the free-stream velocity for use in the drag coefficient measurements and the Reynolds number calculations.

Figure 20:
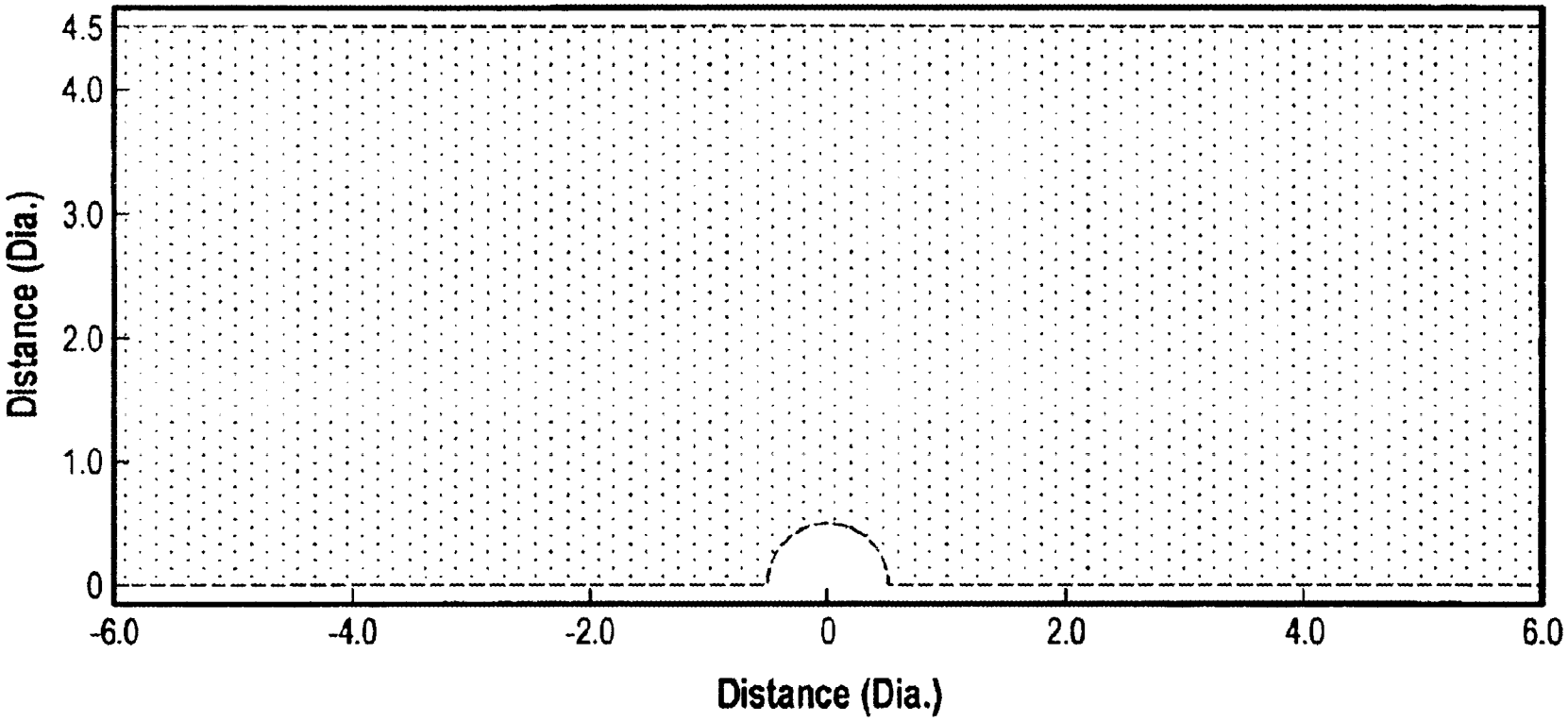
FIG. 20 shows the flow domain for the blockage correction solver.

To compute the blockage correction, a potential flow solver was developed for flow past a cylinder in a channel (see FIG. 20). No allowance was made for the presence of the helical strakes or the sleeve. The effect of the sleeve would have added less than 1 percent to the correction. The symmetry of the flow was used to model only one half of the channel. The free-stream velocity was computed from the strewn function and found to have increased by 2.5 percent over the unblocked value. Subsequently, the nominal test velocities were multiplied by 1.025 to obtain the true (corrected) test velocities for each of the tests conducted here.

TEST RESULTS

Overview of Test Results The following sections discuss the test results and are divided into a section which discusses the effectiveness of the 25 percent coverage perforated shrouds 210 with an underlying axial rod shroud (consisting of twelve equally spaced 3⁄32-inch diameter rods 710) and sections which discuss the effectiveness of the 25 percent 210 and 50 percent 200 perforated shrouds with variations in shroud geometry and current angle and without an underlying axial rod shroud.

While all of the results presented in these sections are plotted in terms of the Reynolds number, it is recognized that there are other parameters that are affected by variations in the flow velocity which can, in turn, affect the vortex-induced vibration. Since the foremost of these other parameters is the reduced velocity, the relationship between nominal test velocity, measured test velocity, Reynolds number, and reduced velocity is presented in FIG. 43.

Figure 21:
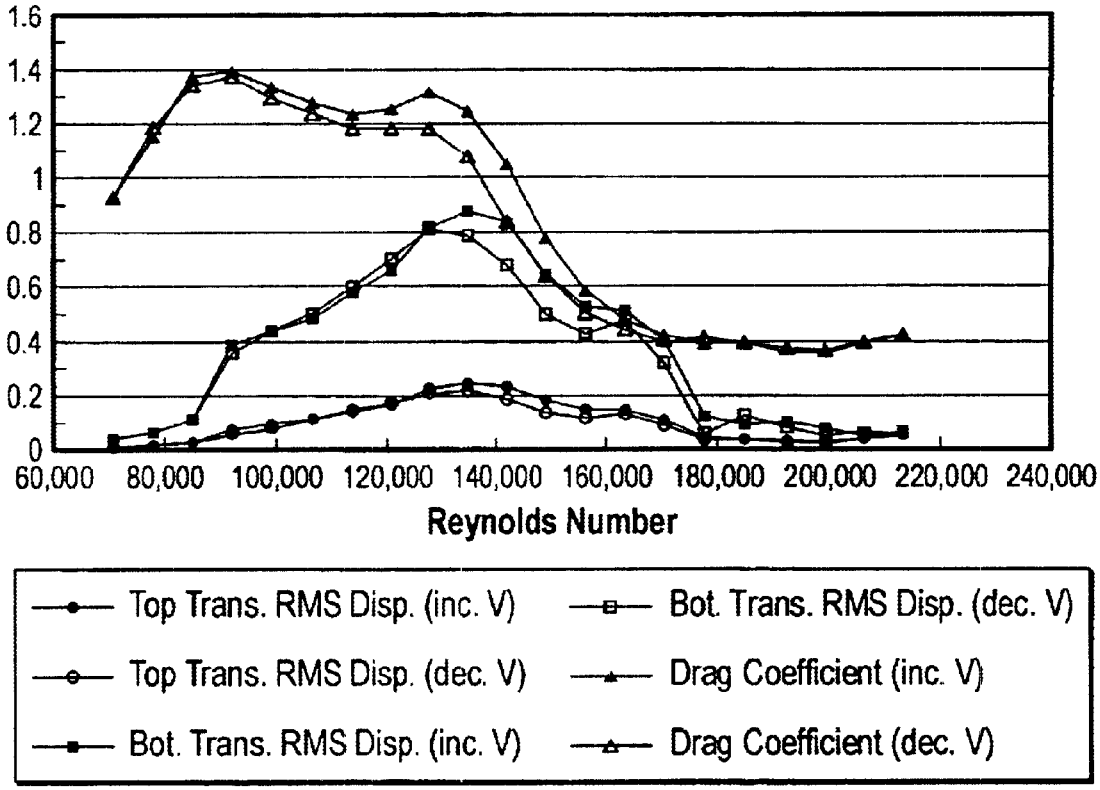
FIG. 21 shows tank test results for drag coefficients and Reynolds numbers under conditions of uniform flow and bare cylinder.

The bare cylinder test displacements and drag coefficients are shown in FIG. 21. This figure shows that the bottom motions (i.e., the motions measured by the bottom accelerometer) were substantially larger than the top motions (the motions measured by the top accelerometer), and that the drag coefficients decreased substantially as the critical Reynolds number range was entered, even though the displacements were still large.

Tests with Underlying Axial Rods (Examples 1–3)

Figure 22:
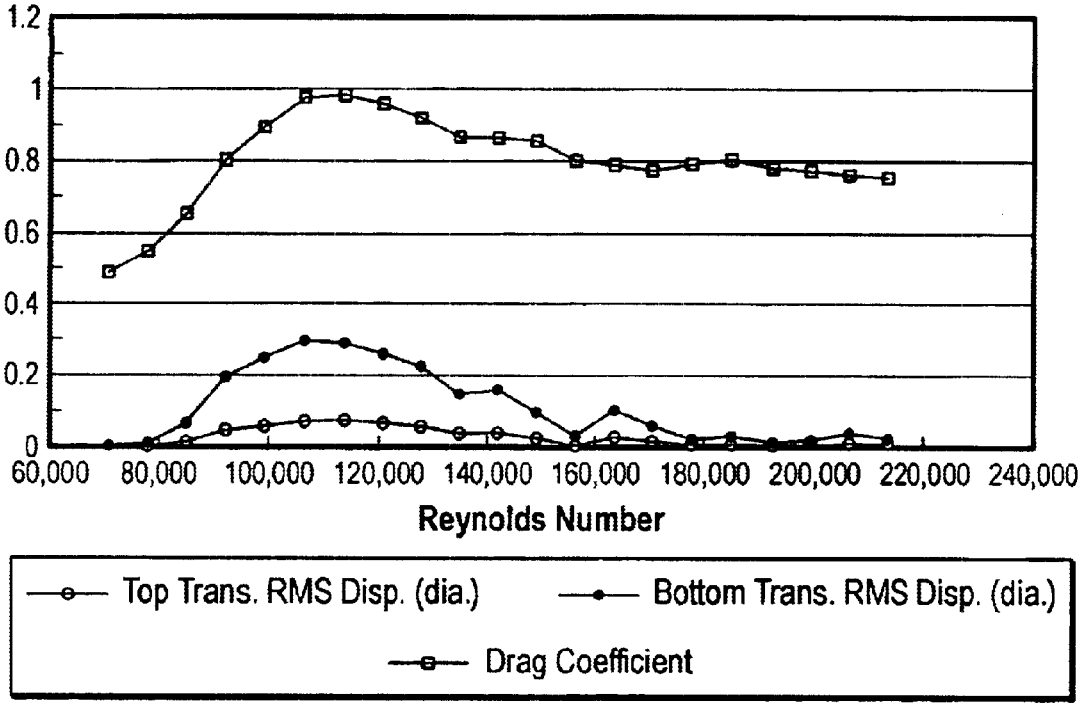
FIG. 22 shows tank test results for drag coefficients and Reynolds numbers with ¼ coverage perforated shroud, ½" holes, 64% porosity, with rods and 0 degree current angle.

Example 1: ½-Inch Holes, 64% Porosity, and 0° Current Angle. The results for this configuration, which consisted of a ¼ coverage perforated shroud at a zero-degree current angle, are shown in FIG. 22. A zero-degree current angle is defined as the angle in which the centerline of the shroud is colinear with the centerline of the wake (i.e., 180 from the stagnation point) for a potential flow case. The figure shows that substantial suppression was obtained with this configuration at all of the test velocities. The drag coefficients are somewhat higher than those of the bare cylinder, but were always less than 1.0, and leveled off at 0.8 at the higher Reynolds numbers.

Figure 23:
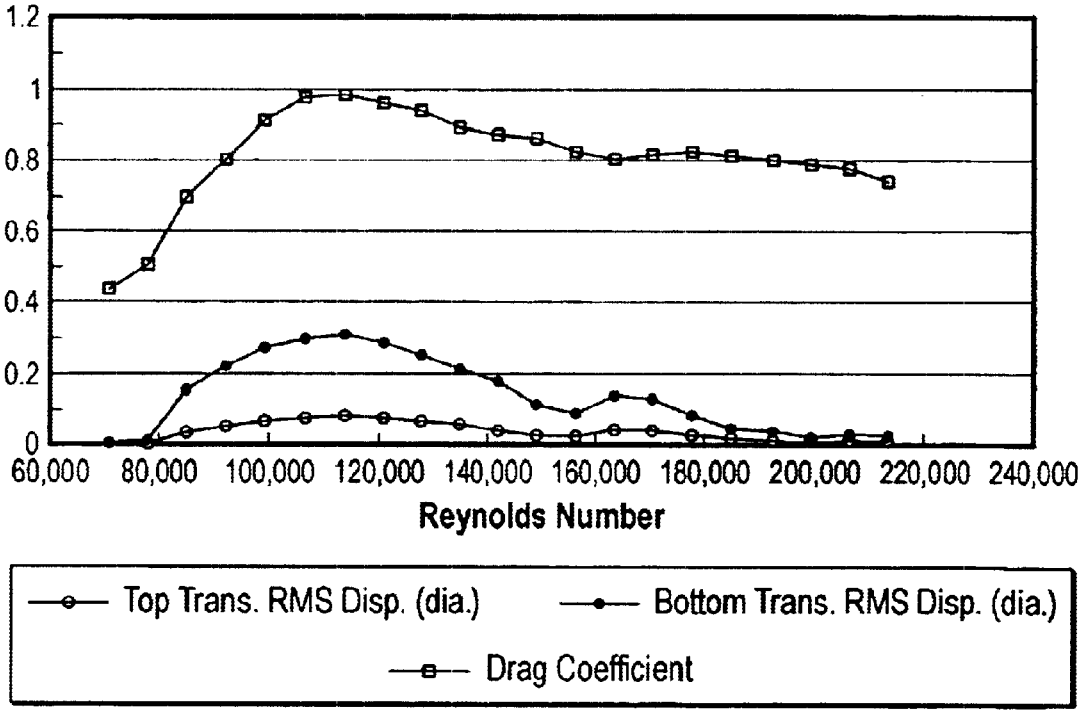
FIG. 23 shows tank test results for drag coefficients and Reynolds numbers for ¼ coverage perforated shroud, ¾" holes, 56% porosity, with rods, and a 0 degree current angle.

Example 2: ¾-Inch Holes, 56% Porosity, and 0° Current Angle. FIG. 23 presents the results for this configuration (also a ¼ coverage perforated shroud). This configuration produced about the same level of suppression as the other shrouds tested with an underlying axial rod shroud with almost identical drag coefficients.

Figure 24:
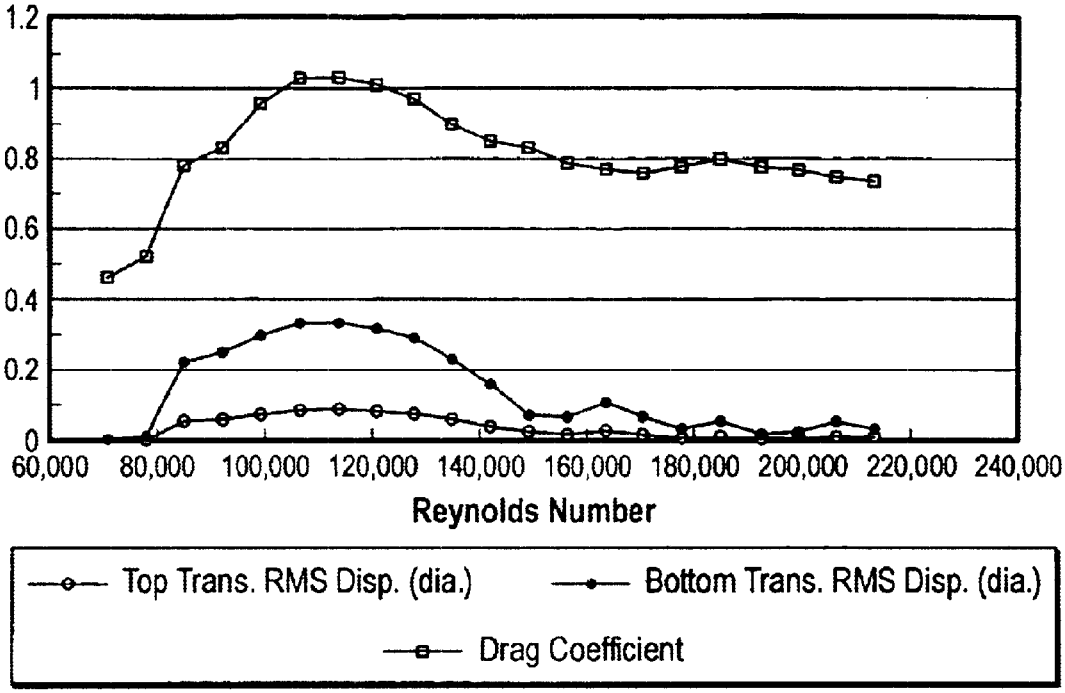
FIG. 24 shows tank test results for drag coefficients and Reynolds numbers for ¼ coverage perforated shroud, ⅞" holes, 76% porosity, with rods and 0 degree current angle.

Example 3: ⅞-Inch Holes, 76% Porosity, and 0° Current Angle. FIG. 24 presents the results for this configuration (also with a ¼ coverage perforated shroud), which produced vibrations and drag coefficients virtually identical to those produced by the other shrouds with an underlying axial rod shroud. Since these shrouds were previously found to be quite effective when fully covering the cylinder's circumference (with an underlying axial rod shroud), these results indicate that, for this axial rod shroud, the effectiveness of this type of configuration is not very sensitive to the geometry of the perforated shroud if the shroud was effective during complete circumferential coverage. It is also worth noting that the suppression effectiveness of these configurations was generally better than that for the axial rod shroud without a perforated shroud, but worse than that for the same configuration with full circumferential coverage with the perforated shroud.

25% Coverage Tests (Examples 4–10)

Figure 25:
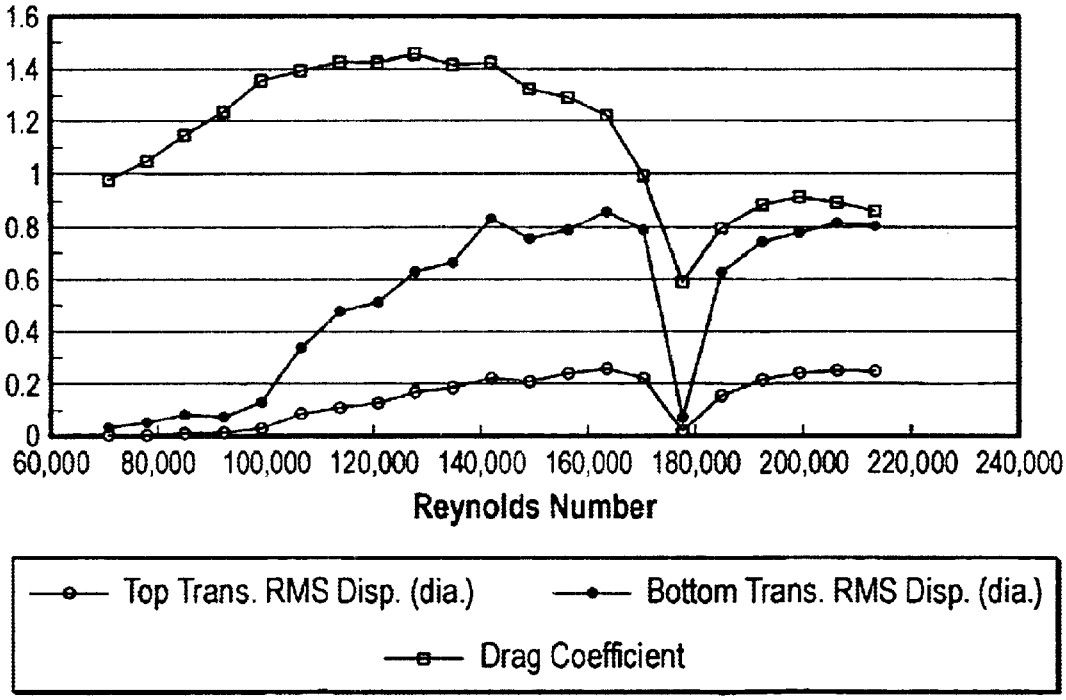
FIG. 25 shows tank test results for drag coefficients and Reynolds numbers for ¼ coverage perforated shroud, ⅜" holes, 56% porosity, without rods and 0 degree current angle.

Example 4: ⅜-inch Holes, 56% Porosity, and 0° Current Angle. FIG. 25 presents the results for this configuration. The figures show that this configuration provided very little overall suppression and had relatively high drag. Some peculiar results were found at a Reynolds number just below 180,000 where the vibration died off substantially, and at a Reynolds number of just below 120,000 where the bottom in-line displacements were very large. The former phenomenon may have been caused by the separation points reaching the location of the shroud (which caused temporary "lock-out" of the vortex shedding).

Figure 26:
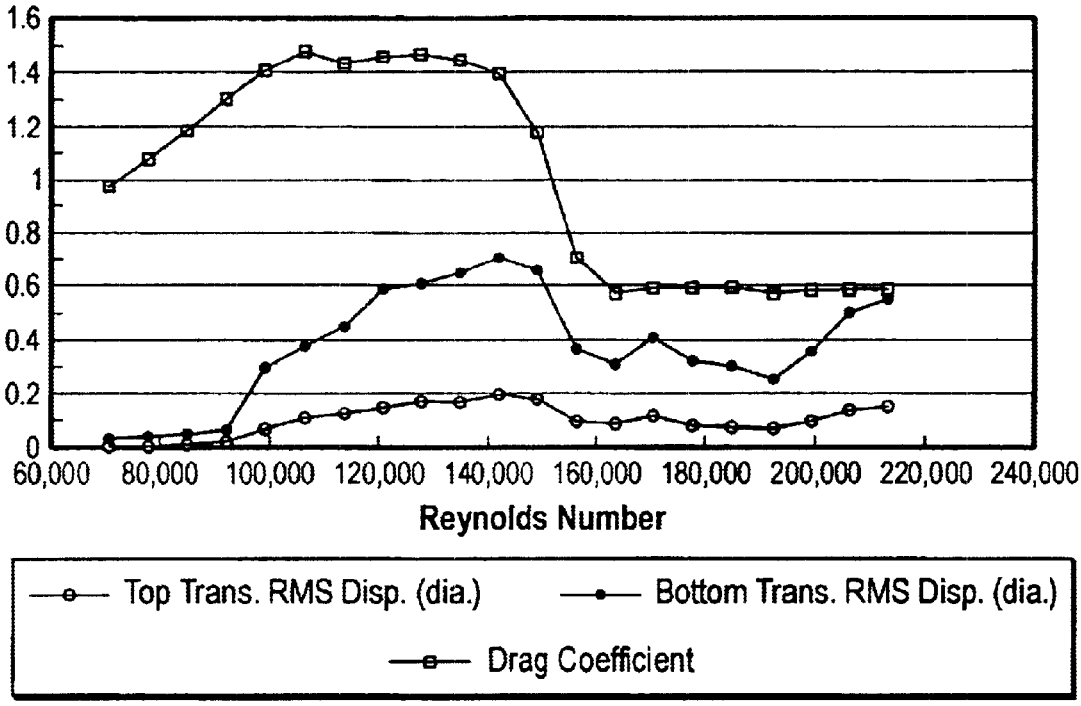
FIG. 26 shows tank test results for drag coefficients and Reynolds number for ¼ coverage perforated shroud, ⅞" holes, 76% porosity, without rods, and 0 degree current angle.

Example 5: ⅞-inch Holes, 76% Porosity, and 0° Current Angle. FIG. 26 presents the results for this configuration, which also was quite ineffective at suppressing VIV. The vibrations for the shrouded cylinder are larger than those for the bare cylinder at high Reynolds numbers. The drag coefficients are somewhat high at subcritical numbers, but only slightly higher than the bare cylinder values at critical Reynolds numbers.

Figure 27:
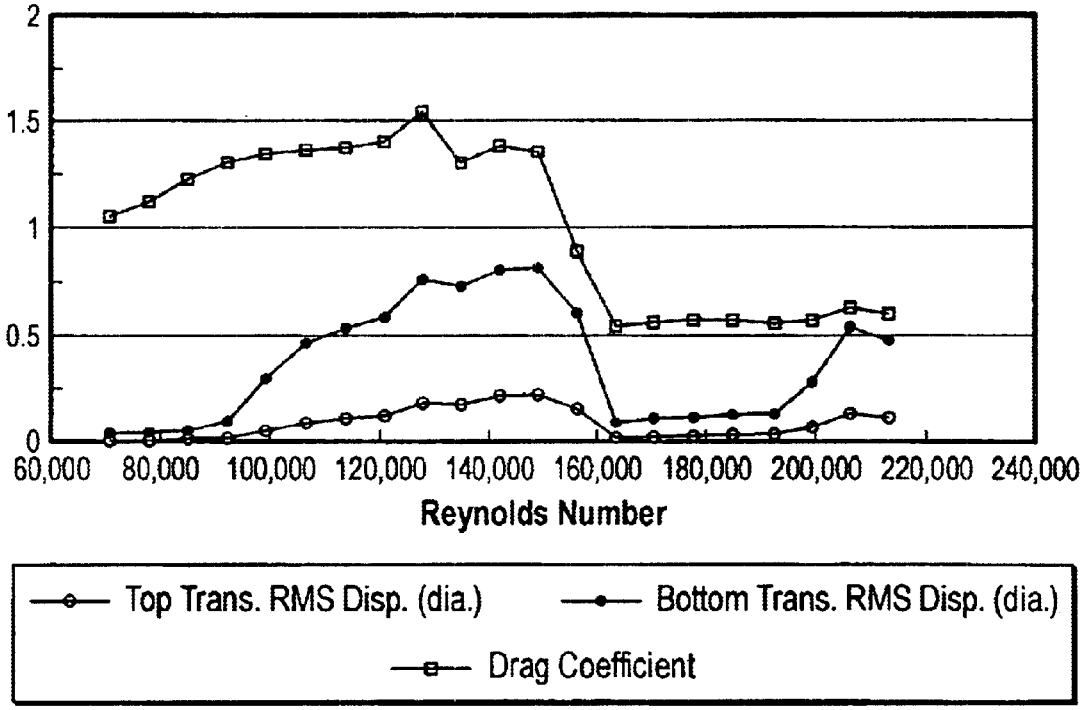
FIG. 27 shows tank test results for drag coefficients and Reynolds numbers for ¼ coverage perforated shroud, ½" holes, 64% porosity, without rods, and 0 degree current angle.

Example 6: ½-inch Holes, 64% Porosity, and 0° Current Angle. FIG. 27 presents the results for this configuration with a 0° current angle. Following sections will present the results for this shroud with other current angles. This shroud, with a 0° current angle, was quite ineffective but did have low drag coefficients at high Reynolds numbers.

Figure 28:
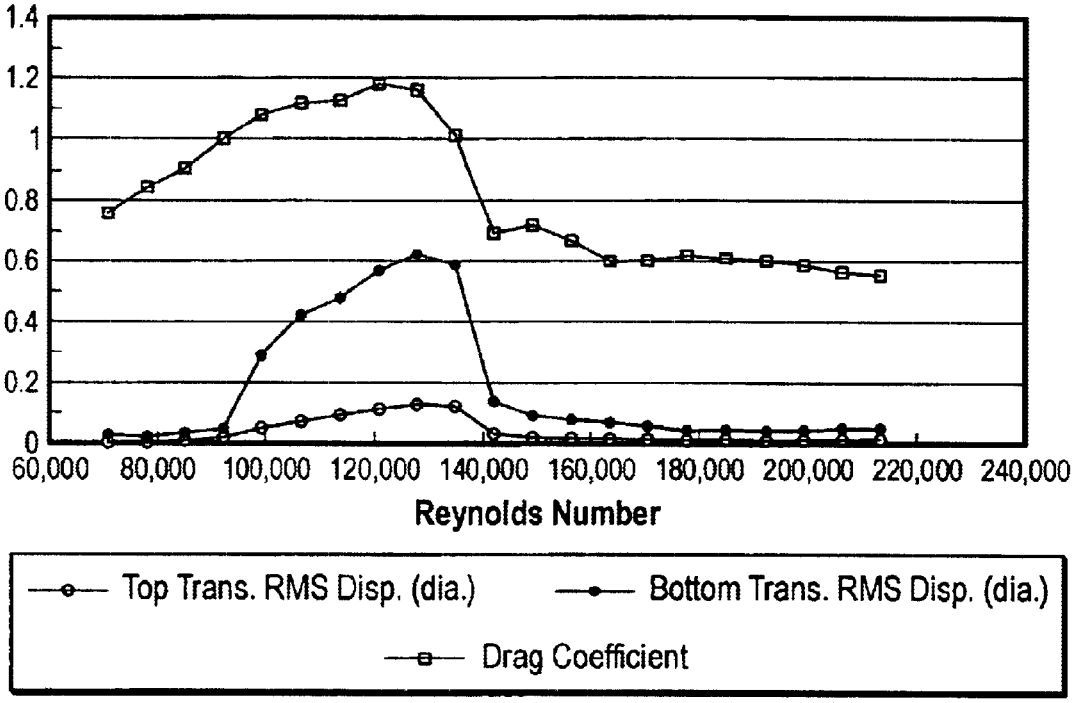
FIG. 28 shows tank test results for drag coefficients and Reynolds numbers for ¼ coverage perforated shroud, ½ holes, 64% porosity, without rods and 22.5 degree current angle.

Example 7: ½-inch Holes, 64% Porosity, and 22.5° Current Angle. FIG. 28 presents the results for this configuration with a 22.5° current angle. This figure shows that this configuration provides significantly more suppression at 22.5° than at 0°, even at higher Reynolds numbers. The drag coefficients are slightly higher than those for a bare cylinder.

Figure 29:
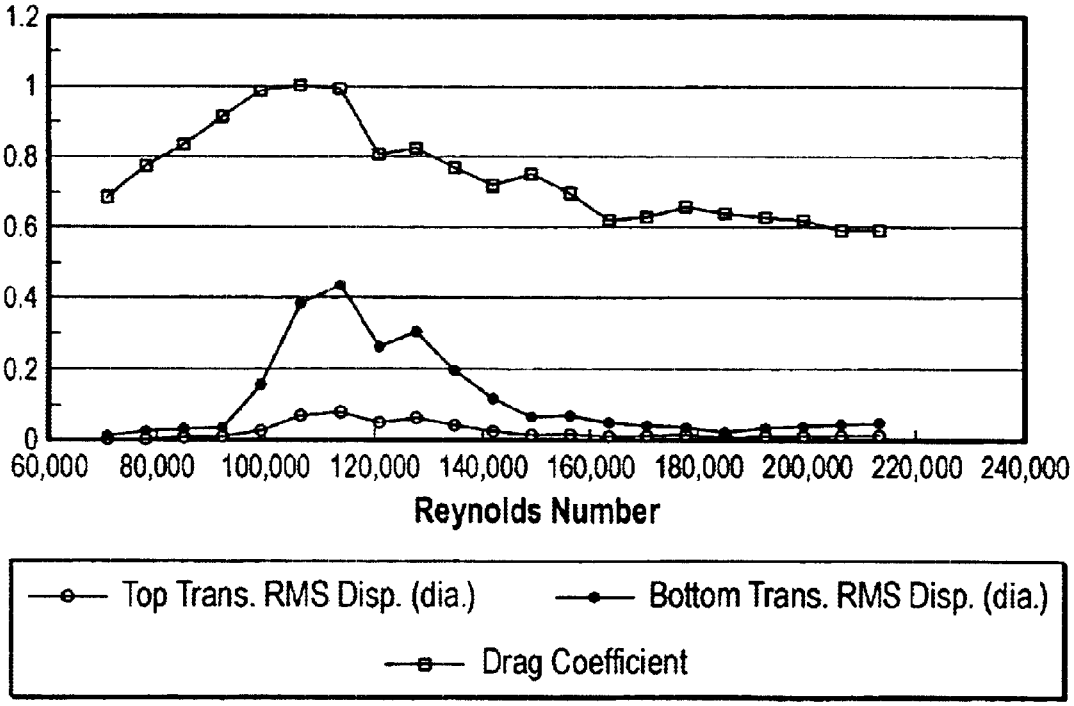
FIG. 29 shows tank test results for drag coefficients, and Reynolds numbers for ¼ coverage shroud, ½" holes, 64% porosity, without rods and 45 degree current angle.

Exhibit 8: ½-inch Holes, 64% Porosity, and 45° Current Angle. FIG. 29 presents the results for this confederation with a 45° current angle. The increase in current angle produced a further improvement in the suppression effectiveness of this shroud. The drag coefficients are lower (than those for the 22.5° current angle) at subcritical Reynolds numbers and about the same at critical Reynolds numbers.

Figure 30:
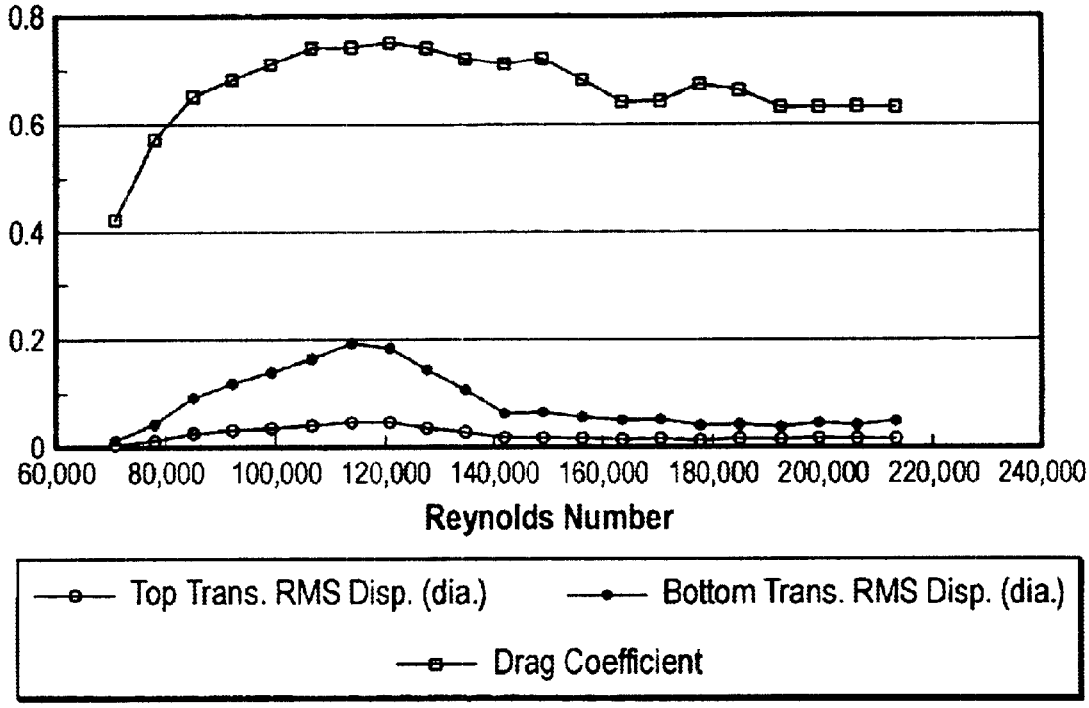
FIG. 30 shows tank test results for drag coefficients and Reynolds numbers for ¼ coverage perforated shroud, ½" holes, 64% porosity, without rods and 45 degree current angle.

Exhibit 9: ½-inch Holes, 64% Porosity, and 67.5° Current Angle. FIG. 30 presents the results for this configuration with a 67.5° current angle. This shroud was more effective at this angle than at any other angle tested. The drag coefficients are also low, averaging about 0.7 for Reynolds numbers greater than 100,000.

Figure 31:
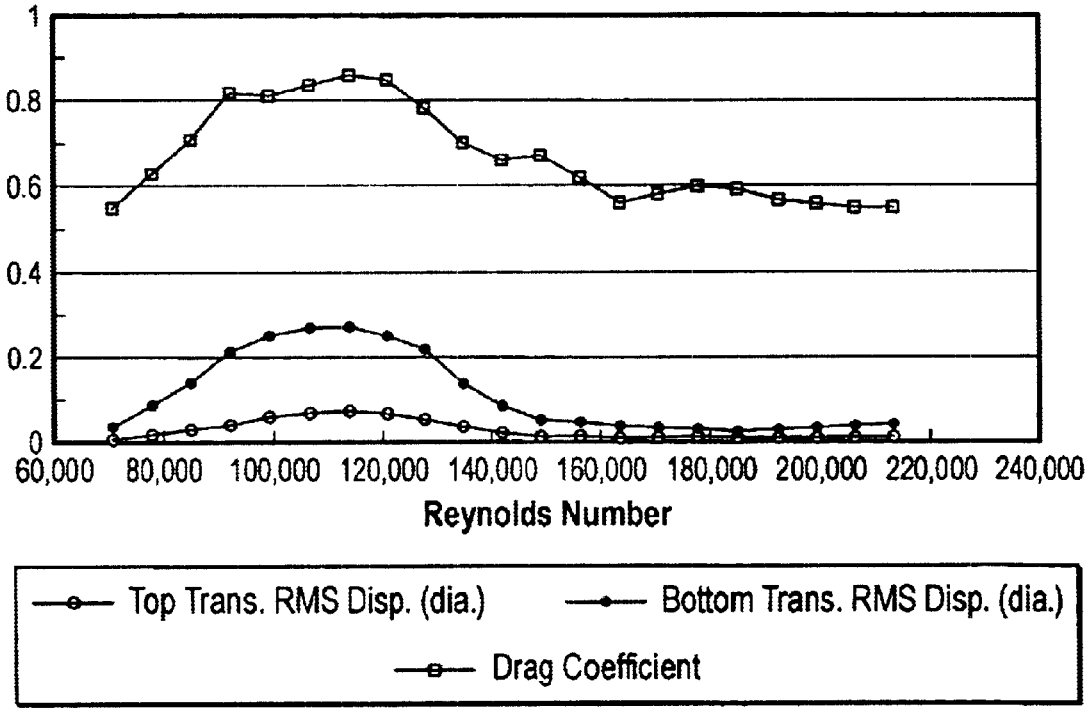
FIG. 31 shows tank test results for drag coefficients and Reynolds number for ¼ coverage perforated shroud, ½" holes, 64% porosity, without rods and 90 degree current angle.

Exhibit 10: ½-inch Holes, 64% Porosity, and 90° Current Angle. FIG. 31 presents the results for this configuration with a 90° current angle. The shroud is not quite as effective as it was at 67.5°, but it still provided substantial suppression. The drag coefficients were generally slightly lower than at 67.5°.

50% Coverage Tests (Examples 11–19)

Figure 32:
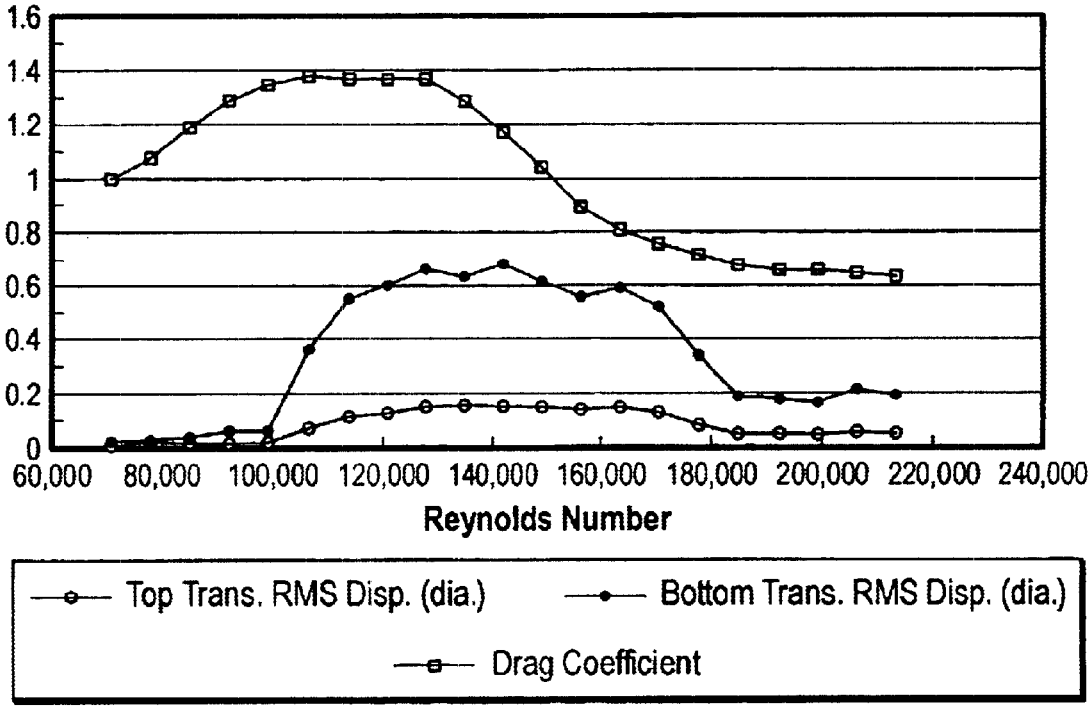
FIG. 32 shows tank test results for drag coefficients and Reynolds numbers for ½ coverage perforated shroud, ½" holes, without rods and 0 degree current angle.

Example 11: ½-inch Holes, 64% Porosity, 0° Current Angle. The results for this configuration, for a 0° current angle, are presented in FIG. 32. Results from tests with other current angles are presented in following sections. This configuration is somewhat more effective than the same shroud with 25% coverage at a 0° current angle and has lower drag coefficients at subcritical Reynolds numbers. The drag coefficients at critical Reynolds numbers are slightly larger than those for the 25% coverage shroud, even though the displacements for this shroud are lower at high Reynolds numbers.

Figure 33:
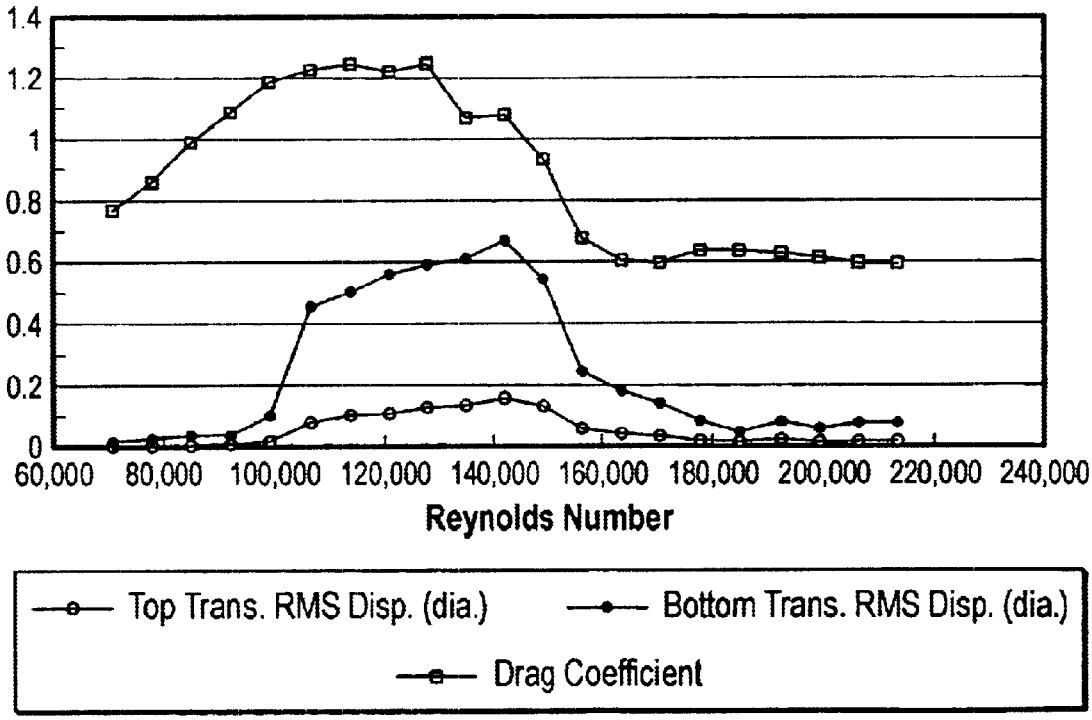
FIG. 33 shows tank test results for drag coefficients and Reynolds numbers for ½ coverage perforated shroud, ½" holes, 64% porosity, without rods and 22.5 degree current angle.

Example 12: ½-inch Holes, 64% Porosity, 22.5° Current Angle. The results for this configuration, for a 22.5° current angle, are presented in FIG. 33. As with the 25% coverage shroud, the suppression effectiveness is slightly better at a 22.5° current angle than at a 0° current angle.

The drag coefficients are also slightly lower for the 22.5° current angle.

Figure 34:
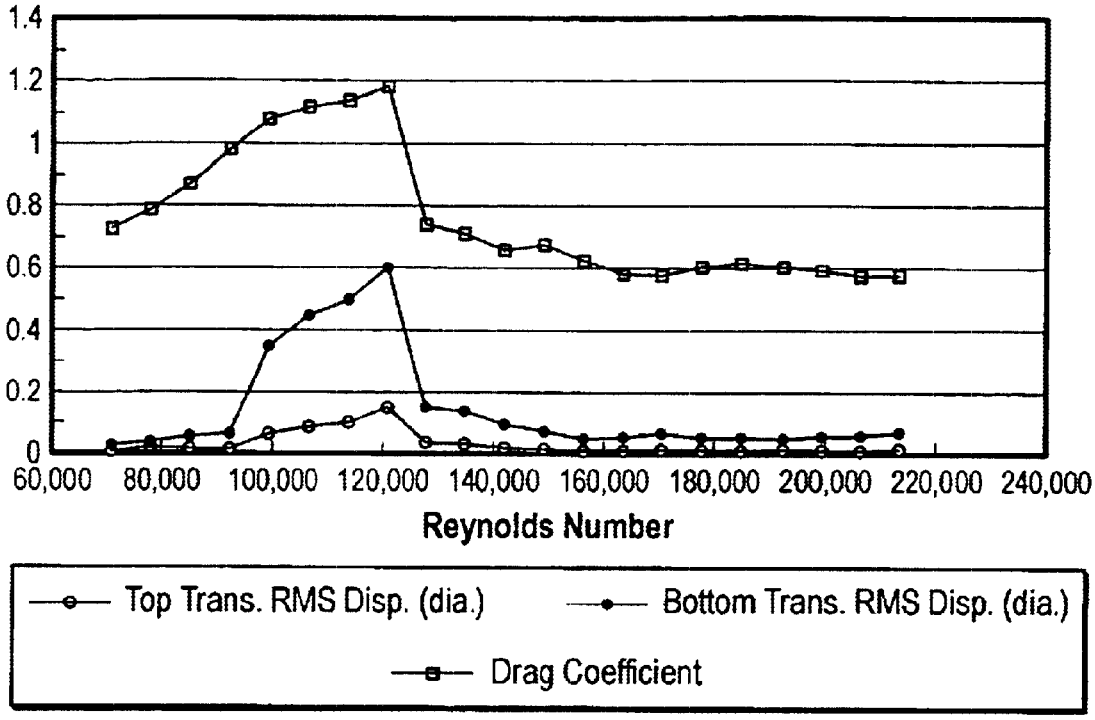
FIG. 34 shows tank test results for drag coefficients and Reynolds number for ½ coverage perforated shroud, ½" holes, 64% porosity, without rods and 45 degree current angle.

Example 13: ½-inch Holes, 64% Porosity, 45° Current Angle. The results for this configuration, for a 45° current angle, are presented in FIG. 34. Further improvement in the shroud's effectiveness is seen at this angle (again like the 25% coverage shroud), but the drag coefficients are about the same as for the 22.5° current angle.

Figure 35:
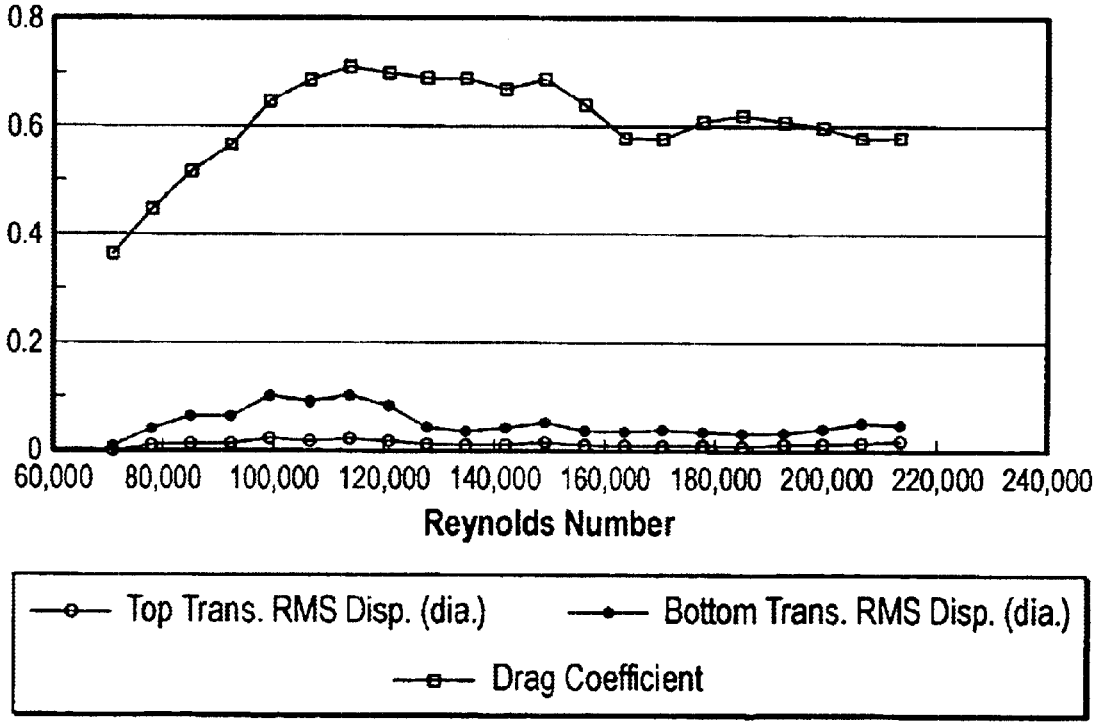
FIG. 35 shows tank test results for drag coefficients and Reynolds numbers for ½ coverage perforated shroud, ½" holes, 64% porosity, without rods and 67.5 degree current angle.

Example 14: ½-inch Holes, 64% Porosity, 67.5° Current Angle. The results for this configuration, for a 67.5° current angle, are presented in FIG. 35. The shroud provided excellent VIV suppression at this current angle, suppressing the vibrations to very small levels. The corresponding drag coefficients are also small, reaching maximums of about 0.7 in the critical Reynolds number range and averaging about 0.6 in the critical Reynolds number range.

Figure 36:
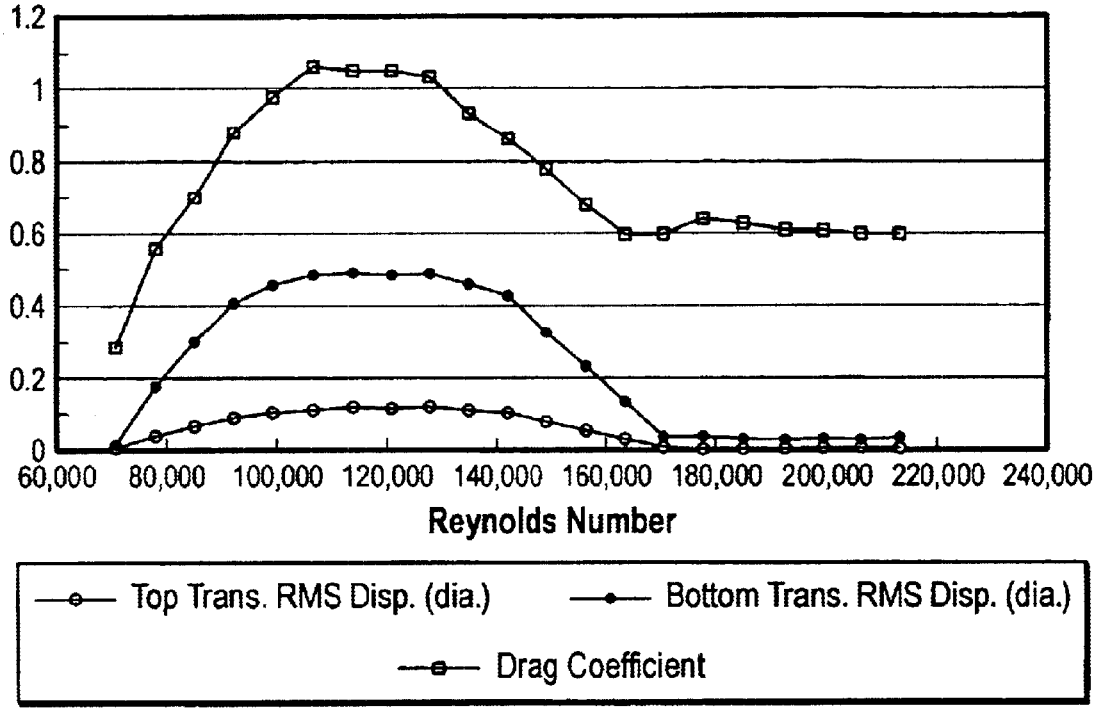
FIG. 36 shows tank test results for drag coefficients and Reynolds numbers for ½ coverage perforated shroud, ½" holes, 64% porosity and 90 degree current angle.

Example 15: ½ -inch Holes, 64% Porosity, 90° Current Angle. The results for this configuration, for a 90° current angle, are presented in FIG. 36. The shroud is not nearly as effective at this current angle as it was at 67.5°, but still provides some suppression. The drag coefficients at subcritical Reynolds numbers are higher than those at the 67.5° current angle.

Figure 37:
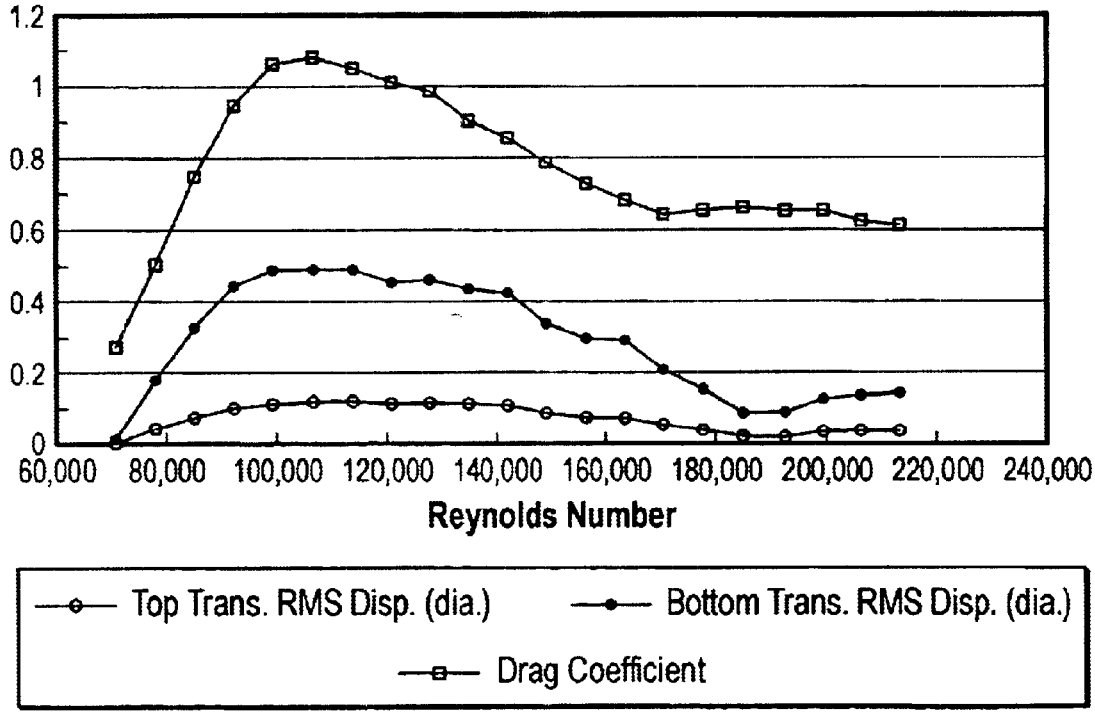
FIG. 37 shows tank test results for drag coefficients and Reynolds numbers for ½ coverage perforated shroud, ½" holes, without rods and 112.5 degree current angle.

Example 16: ½-inch Holes, 64% Porosity, 112.5° Current Angle. The results for this configuration, for a 112.5° current angle, are presented in FIG. 37. The shroud has about the same effectiveness at this current angle as it has at 90°, with the exception that the vibrations are slightly worse for this current angle at the higher Reynolds numbers.

Figure 38:
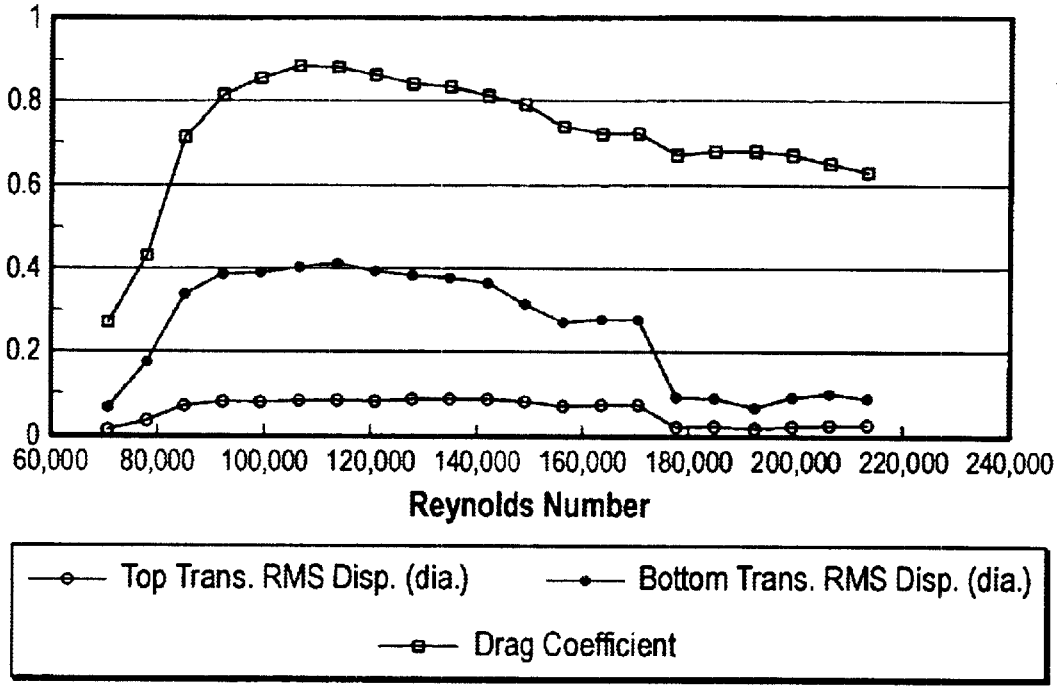
FIG. 38 shows tank test results for drag coefficients and Reynolds numbers for ½ coverage perforated shroud, ½" holes, 64% porosity, without rods and 135 degree current angle.

Example 17: ½-inch Holes, 64% Porosity, 135° Current Angle. The results for this configuration, for a 135° current angle, are presented in FIG. 38. The shroud has improved suppression effectiveness at this current angle relative to its effectiveness at 112.5°. The drag coefficients are also slightly lower at this current angle.

Figure 39:
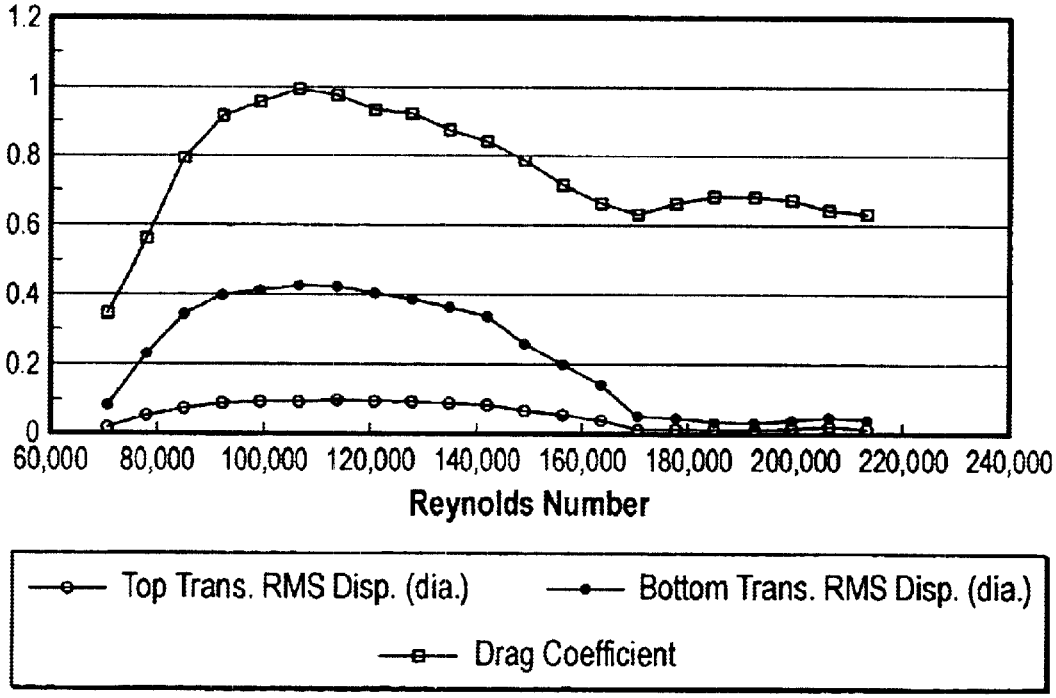
FIG. 39 shows tank test results for drag coefficients and Reynolds numbers for ½ coverage perforated shroud, ½" holes, 64% porosity, without rods and 157.5 degree current angle.

Example 18: ½-inch Holes, 64% Porosity, 157.5° Current Angle. The results for this configuration, for a 157.5° current angle, are presented in FIG. 39. The vibrations are a bit higher for this current angle compared to those for the 135° current angle, but the difference is very slight. The drag coefficients are also slightly higher at subcritical Reynolds numbers for this current angle.

Figure 40:
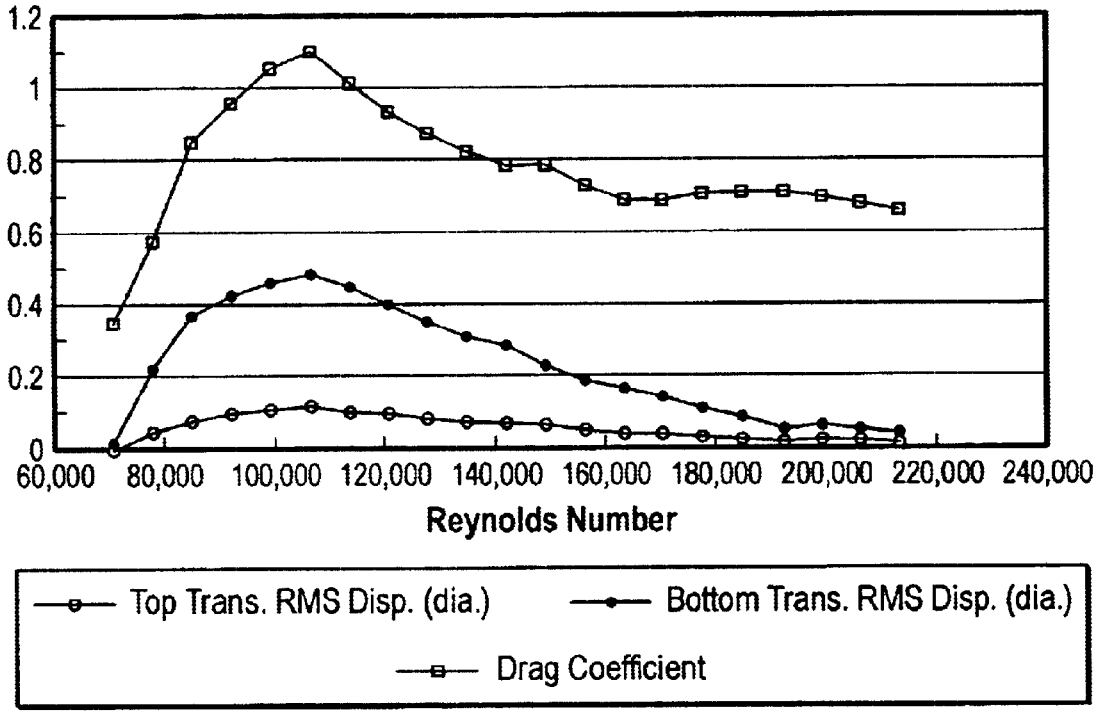
FIG. 40 shows tank test results for drag coefficients and Reynolds numbers for ½ coverage perforated shroud, ½" holes, 64% porosity, without rods and 180 degree current angle.
Figure 41:
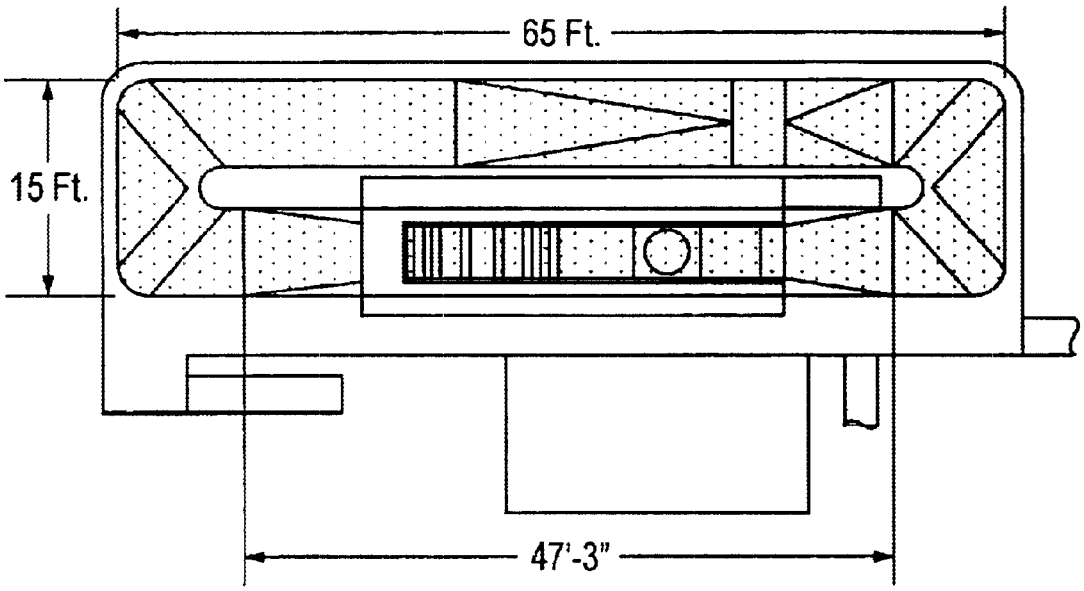
FIGS. 41 and 42 show plan and sectional views respectively of the current tank facility with dimensions provided.
Figure 42:
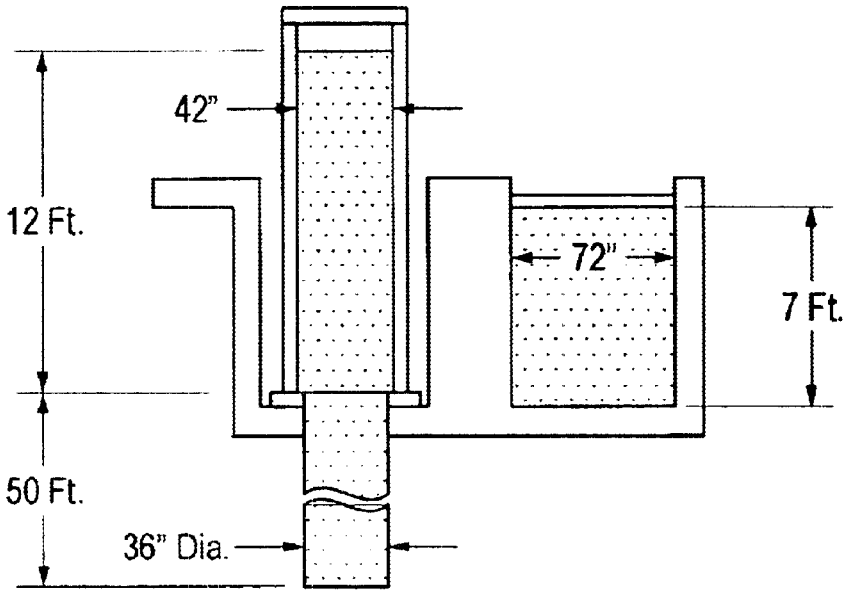

Example 19: ½-inch Holes, 64% Porosity, 180° Current Angle. The results for this configuration, for a 180° current angle, are presented in FIG. 40. At the lower Reynolds numbers, the shroud is slightly less effective at this current angle than at 135 and 157.5°, but is more effective at the moderate to high Reynolds numbers. The drag coefficients are slightly higher than those for the 135 and 157.5° current angles.

DISCUSSION OF EXAMPLE RESULTS

Example results show that:

1. For the ¼ coverage shrouds 210, the effectiveness is improved by the presence of the underlying axial rods 710;
2. The ½ coverage shroud 200 is generally more effective than the ¼ coverage shroud 210; and
3. The optimal current angle for both amounts of coverage is about 67.5°.

These results indicate that perforated shrouds partially covering the circumference of a minispar may provide sufficient VIV suppression, depending on the amount of suppression required. This type of partial-coverage perforated shroud may also provide sufficient suppression for risers and pipeline spans, which is particularly useful since these shrouds could be more easily installed underwater than shrouds which fully cover the circumference.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

We claim:

1. A system for use with a flowing-fluid element subject to vortex induced vibration, said system comprising:

(a) a shroud defining a plurality of perforations, wherein the shroud is suitable for placement around the flowing-fluid element, and wherein the shroud is suitable for providing a percent or encirclement of the flowing-fluid element in the range of about 12% to about 80%, wherein the shroud has a cross-sectional circular segment shape of from about 43° to about 288°, wherein said flowing-fluid element is subject to a fluid current having a direction, and wherein said shroud is centered around said flowing-fluid element at an angle in the range of about 62 to about 72 degrees relative to the direction of said current; and (b) at least one separation member in contact with the shroud, wherein the separation member is suitable for positioning between the flowing-fluid element and the shroud to maintain the shroud and flowing-fluid element in relative position to each other.

2. The system of claim 1, wherein the shroud is suitable for providing a percent of encirclement of the flowing-fluid element in the range of about 25% to about 70% and has a cross-sectional circular segment shape of from about 90% to about 252°.

3. The system of claim 1, wherein the shroud comprises a porosity in the range of about 10% to about 80%.

4. The system of claim 1, wherein at least one of the perforations comprise a shape selected from the group consisting of regular n-sided, irregular n-sided, linear, and curvilinear geometric shapes.

5. The system of claim 4, wherein at least one of the perforations comprise a shape selected from the group consisting of square, rectangle, triangle, circle, oval, and ellipsoid.

6. The system of claim 1, wherein the perforations are arranged in a regular or irregular pattern.

7. The system of claim 1, wherein the separation member comprises a ring-shaped separation member.

8. The system of claim 1, wherein the flowing fluid element comprises a portion of an offshore structure or a pipeline.

9. The system of claim 1, comprising at least two separation members, and further comprising:

(c) at least one axial rod positioned between and connecting two adjacent separation members.

10. The system of claim 9, wherein the axial rod is further positioned between the shroud and the flowing-fluid element.

11. The system of claim 1, wherein the flowing-fluid element is part of a structure selected from the group consisting of bottom supported structures, vertically moored structures, floating production systems and subsea systems.

12. The system of claim 1, wherein the shroud is suitable for providing a percent of encirclement of the flowing-fluid element in the range of about 25% to about 70% and has a cross-sectional circular segment shape of from about 90° to about 252° wherein the shroud comprises a porosity in the range of about 10% to about 80%, wherein at least one of the perforations comprises a shape selected from the group consisting of regular n-sided, irregular n-sided, linear, and curvilinear geometric shapes, and wherein said flowing-fluid element is subject to a fluid current having a direction, and wherein said shroud is centered around said flowing-fluid element at an angle of about 67.5 degrees relative to the direction of said current.

13. A system suitable for use in vortex induced vibration prone environments, said system comprising:

(a) a flowing-fluid element; and (b) a shroud positioned around the flowing-fluid element, where the shroud defines a plurality of perforations, and wherein the shroud encircles the flowing-fluid element at a percent of encirclement in the range of about 12% to about 80%, and wherein the shroud has a cross-sectional circular segment shape of from about 43° to about 288°, and wherein said flowing-fluid element is subject to a fluid current having a direction, and wherein said shroud is centered around said flowing-fluid element at an angle in the range of about 62 to about 72 degrees relative to the direction of said current.

14. The system of claim 13, further comprising:

(e) at least one separation member positioned between the flowing-fluid element and the shroud, maintaining the shroud and flowing-fluid element in relative position to each other.

15. The system of claim 13, wherein the shroud provides a percent of encirclement of the flowing-fluid element in the range of about 25% to about 70%, and has a cross-sectional circular segment shape of from about 90° to about 252°.

16. The system of claim 13, wherein the shroud comprises a porosity in the range of about 15% to about 80%.

17. The system of claim 13, wherein at least one of the perforations comprise a shape selected from the group consisting of regular n-sided, irregular n-sided, linear, and curvilinear geometric shapes.

18. The system of claim 17, wherein at least one of the perforations comprise a shape selected from the group consisting of square, rectangle, triangle, circle, oval, and ellipsoid.

19. The system of claim 13, wherein the perforations are arranged in a regular or irregular pattern.

20. The system of claim 13, wherein the separation member comprises a ring-shaped separation member.

21. The system of claim 13, wherein the flowing fluid element comprises a portion of an offshore structure or a pipeline.

22. The system of claim 13, comprising at least two separation members, and further comprising:

(d) at least one axial rod positioned between and connecting two adjacent separation members.

23. The system of claim 22, wherein the axial rod is further positioned between the shroud and the flowing-fluid element.

24. The system of claim 13, wherein the flowing-fluid element is in contact with a structure selected from the group consisting of bottom supported structures, vertically moored structures, floating production systems and subsea systems.

25. The system of claim 24, wherein the shroud is suitable for providing a percent of encirclement of the flowing-fluid element in the range of about 25% to about 55% and has a cross-sectional circular segment shape of from about 90° to about 198°, wherein the shroud comprises a porosity in the range of about 25% to about 70%, wherein at least one of the perforations comprises a shape selected from the group consisting of regular n-sided, irregular n-sided, linear, and curvilinear geometric shapes, and wherein said shroud is centered around said flowing-fluid element at an angle of about 67.5 degrees relative to the direction of said current.

26. A method for modifying a flowing-fluid element subject to vortex induced vibration, said method comprising:

(a) positioning a shroud around the flowing-fluid element, wherein the shroud defines a plurality of perforations, wherein the shroud is suitable for placement around the flowing-fluid element, and wherein the shroud is suitable for providing a percent of encirclement of the flowing-fluid element in the range of about 12% to about 80% and has a cross-sectional circular segment shape of about 43° to about 288°, and wherein said flowing-fluid element is subject to a fluid current having a direction, and wherein said shroud is centered around said flowing-fluid element at an angle in the range of about 62 to about 72 degrees relative to the direction of said current.

27. The method of claim 26, further comprising:

(b) positioning at least one separation member between the flowing-fluid element and the shroud.

28. The method of claim 27, further comprising:

(c) positioning at least one axial rod between two adjacent separation members.

29. The method of claim 28, wherein the positioning of step (c) further comprises positioning the rod between the shroud and the flowing-fluid element.

30. The system of claim 26, wherein the flowing-fluid element is in contact with a structure selected from the group consisting of bottom supported structures, vertically moored structures, floating production systems and subsea systems.

31. The method of claim 26, wherein the shroud is suitable for providing a percent of encirclement of the flowing-fluid element in the range of about 25% to about 70% and has a cross-sectional circular segment shape of about 90° to about 252°, wherein the shroud comprises a porosity in the range of about 25% to about 70%, wherein at least one of the perforations comprises a shape selected from the group consisting of regular n-sided, irregular n-sided, linear, and curvilinear geometric shapes.

32. The method of claim 26, wherein the shroud provides a percent of encirclement of the flowing-fluid element in the range of about 25% to about 70% and has a cross-sectional circular segment shape of about 90° to about 252°, and wherein said shroud is centered around said flowing-fluid element at an angle of about 67.5 degrees relative to the direction of said current.

33. The method of claim 26, wherein the shroud comprises a porosity in the range of about 10% to about 80%.

* * * * *